US011619016B2

(12) United States Patent
Hoffman et al.

(10) Patent No.: US 11,619,016 B2
(45) **Date of Patent: *Apr. 4, 2023**

(54) MULTI-POSITION SNOWPLOW BLADE WITH TRANSLATABLE TRIP EDGE

(71) Applicant: Venture Products, Inc., Orrville, OH (US)

(72) Inventors: Michael S. Hoffman, Greenwich, OH (US); Corey Gerber, Smithville, OH (US)

(73) Assignee: VENTURE PRODUCTS, INC., Orrville, OH (US)

( * ) Notice: Subject to any disclaimer, the term of this patent is extended or adjusted under 35 U.S.C. 154(b) by 348 days.

This patent is subject to a terminal disclaimer.

(21) Appl. No.: 17/012,258

(22) Filed: Sep. 4, 2020

(65) Prior Publication Data

US 2022/0074154 A1 Mar. 10, 2022

(51) Int. Cl.
*E01H 5/06* (2006.01)

(52) U.S. Cl.
CPC ..... *E01H 5/065* (2013.01); *E01H 5/061* (2013.01)

(58) Field of Classification Search
CPC ..... E01H 5/065; E01H 5/061; E01H 5/066; E01H 5/063; E01H 5/062; E01H 5/06
USPC ..... 37/232
See application file for complete search history.

(56) References Cited

U.S. PATENT DOCUMENTS 3,650,054 A * 3/1972 Hanson ..... E01H 5/063 172/264
3,772,803 A 11/1973 Cote
3,998,342 A * 12/1976 Myers ..... E02F 9/18 280/759
4,074,448 A * 2/1978 Niemela ..... E01H 5/065 37/234
4,597,202 A 7/1986 Weeks
4,907,358 A 3/1990 Moore
5,025,577 A 6/1991 Verseef
5,109,618 A * 5/1992 Grubler ..... E01H 5/063 403/328
5,437,113 A 8/1995 Jones
6,125,559 A * 10/2000 Mullenhour ..... E01H 5/062 37/232
7,437,839 B2 10/2008 Christy et al.
7,743,536 B2 6/2010 Evans et al.
(Continued)

FOREIGN PATENT DOCUMENTS

WO WO-2020087179 A1 * 5/2020 ..... E01H 5/062

*Primary Examiner* — Jamie L McGowan

(74) *Attorney, Agent, or Firm* — Sand, Sebolt & Wernow Co., LPA

(57) ABSTRACT

A V-blade for a snowplow, a snowplow incorporating the V-blade and a method of use thereof. The blade includes left and right wings engaged with a central shaft. A trip edge is provided on each wing and includes a lower section of moldboard, a cutting edge, and snow shield engaged with an upper section of the moldboard via a biasing assembly. The assembly biases the trip edge into alignment with the upper section. When an obstacle on the surface is struck by the trip edge, the trip edge pivots relative to the upper section about a horizontal axis extending along a shaft of the biasing assembly. A translation assembly causes the trip edge to move laterally in a first direction away from the central shaft and parallel to the vertical axis extending therealong. The trip edge returns to its original position under spring force.

20 Claims, 14 Drawing Sheets

(56) References Cited

U.S. PATENT DOCUMENTS

| | | | | |
|---|---|---|---|---|
| 9,051,700 | B2 * | 6/2015 | Summers | E01H 5/063 |
| 10,865,534 | B2 * | 12/2020 | Martin | E01H 5/066 |
| 2006/0000122 | A1 * | 1/2006 | Micozzi | E01H 5/063 37/232 |
| 2006/0042128 | A1 | 3/2006 | Schultz et al. | |
| 2007/0271828 | A1 * | 11/2007 | Mishra | E01H 5/066 37/231 |
| 2009/0282706 | A1 * | 11/2009 | Barker | E01H 5/061 37/196 |
| 2013/0232827 | A1 * | 9/2013 | Summers | E01H 5/062 37/274 |
| 2014/0237865 | A1 * | 8/2014 | Jones | E01H 5/066 16/374 |
| 2016/0076285 | A1 * | 3/2016 | Jones | E01H 5/066 16/382 |
| 2018/0127935 | A1 | 5/2018 | Paonessa | |
| 2019/0017237 | A1 | 1/2019 | Michel et al. | |
| 2019/0136473 | A1 | 5/2019 | Desrochers et al. | |
| 2019/0136474 | A1 * | 5/2019 | Martin | E01H 5/062 |
| 2019/0203436 | A1 | 7/2019 | Martin et al. | |
| 2019/0234034 | A1 | 8/2019 | Kovalick | |
| 2019/0323204 | A1 | 10/2019 | Vigneault | |
| 2022/0243411 | A1 | 8/2022 | Vigneault et al. | |

* cited by examiner

MULTI-POSITION SNOWPLOW BLADE WITH TRANSLATABLE TRIP EDGE

BACKGROUND

Technical Field

This disclosure is directed to snow removal equipment. In particular the disclosure relates to a snowplow blade. Specifically, the disclosure is directed to a snowplow blade having left and right wings where each wing includes a trip edge that is both pivotable and linearly-translatable when tripped. When the blade strikes an obstacle on a surface while clearing snow therefrom, one or both trip edges will pivot about an associated horizontal axis and relative to an associated moldboard of the wing. When the blade is in a V-shape and both trip edges trip and pivot, the two trip edges tend to impinge upon each other, causing them to push away from one another and thereby move the trip edges linearly away from one another in opposite directions.

Background Information

Snowplows are used to remove accumulated snow from surfaces such as roadways and sidewalks. The plows typically comprise some type of vehicle, such as a truck or utility vehicle, and a snowplow blade that is mounted to the vehicle by a hitch assembly. Snowblade blades can be straight blades, V-shaped blades that present an apex as the leading edge of the blade, and adjustable blades that can be manipulated to form a V-shape, an inverted V-shape, or be configured as a straight blade. The hitch assembly can be utilized to manipulate the blade by raising or lowering the same. In some instances, the hitch assembly can also be used to angle the snowplow blade relative to a vertical axis of the vehicle to more effectively remove snow from a surface.

Regardless of the configuration of the snowplow blade, these blades typically include a concavely-curved surface for gathering snow from a surface over which the vehicle and blade travel and redirecting the snow away from the surface. This curved surface is known as the moldboard and is typically fabricated from a material such as steel and or even stainless steel. The moldboard is therefore a relatively expensive piece of equipment. In order to preserve the integrity of the moldboard and increase the component's life, a separate cutting edge (also known as a wear board, wear blade, or scraper) is removably engaged the bottom edge of the moldboard. The cutting edge is the component of the snowplow blade that will travel along the surface of the roadway or sidewalk and scrape snow off the same, directing that snow upwardly toward the moldboard. The cutting edge may be fabricated from less-expensive materials than the moldboard. In some embodiments, the cutting edge may be fabricated from a less expensive steel or from materials such as urethane. Over time, the cutting edge will be worn down by its constant contact with the roadways or sidewalks from which the snowplow blade removes snow. If the cutting edge is worn down to too great an extent, the moldboard may start to contact the ground and become damaged. Consequently, when it is determined the cutting edge has reached this point, the cutting edge may be removed from the moldboard and be replaced with a new cutting edge.

One of the issues that occurs when clearing snow is that the roadways and sidewalks can include solid obstacles such as manhole covers, uneven sidewalk slabs, curbs, and so on. If the snowplow is moving along the roadway or sidewalk with the snowplow blade in a lowered position removing snow from the surface, when the blade strikes the obstacle, the impact of that strike can damage the blade or the hitch assembly. The impact force can also be transferred back into the vehicle making the ride jarring and uncomfortable for the snowplow operator.

In order to aid in addressing this problem, some snowplow blades have been configured to trip when they strike solid obstacles. This "tripping" has taken two different forms in the prior art. In some instances, the entire snowplow blade (moldboard plus cutting edge) will lift vertically and/or pivot slightly about a horizontal axis as a unit when an obstacle is struck. In some instances, the horizontal axis about which the entire blade pivots is an axis located on the hitch assembly. Examples of the entire moldboard tripping include U.S. Pat. No. 4,074,448 (Niemela) and U.S. Pat. No. 4,907,358 (Moore).

In other instances, only the cutting edge of the snowplow blade will trip when an obstacle is struck by the cutting edge. In some instances the cutting edge will lift vertically to a certain degree relative to the moldboard. In other instances, the cutting edge will pivot relative to the moldboard about a horizontal axis. Examples of snowplows where only the cutting edge trips include U.S. Pat. No. 3,772,803 (Cote), U.S. Pat. No. 5,025,577 (Verseef), and U.S. Pat. No. 5,437,113 (Jones).

In some instances, the snowplow blades can include both moldboard tripping and cutting edge (i.e., wear blade) tripping. An example of this configuration is found in U.S. Pat. No. 9,051,700 (Summers et al).

V-shaped snowplow blades present a particular problem when they strike obstacles in the roadway or on the sidewalk. V-shaped snowplow blades includes a left side blade or "left wing" and a right side blade or "right wing". The left wing and right wing may be fixedly secured to one another so that the blade is permanently V-shaped. In these instances, the blades are frequently mounted that the entire moldboard (i.e., the entire blade) trips when the blade encounters an obstacle. In other instances, the central region between the left wing and right wing and below a shaft to which the wings are attached will be free of a cutting edge. A trippable cutting edge will be engaged with the left wing and another trippable cutting edge will be engaged with the right wing. The two cutting edges will be sufficiently distanced from one another so as not to strike one another when they trip. If the two cutting edges are physically too close to one another then, when they trip, they might strike one another and become damaged.

In other instances, the V-shaped blade is adjustable in configuration as indicated earlier herein. U.S. Pat. No. 9,051,700 (Summers et al) referred to earlier herein discloses a multi-position V-shaped snowplow blade that can be adjusted to various different configurations. The left wing and right wing of these adjustable V-shaped blades will connect to a central hinge and will be rotatable about a vertical axis that extends along the central hinge. The region between the bottom regions of the left wing and right wing is generally triangular in shape and a separate component, a snow catcher or snow shield, is engaged with each wing. The shield(s) close off the triangular shaped gap between the bottom regions of the left wing and right wing and will contact the surface so that as the blade travels over the surface snow is cleared from even below the central hinge. When the blade is in an inverted V-shape with the apex as the leading part of the blade, this arrangement does not present too many issues if the wear blade on only one or the other of the left wing and right wing trips. However, if the snowplow blade impacts an obstacle that causes the cutting edges or wear blades on both the left and right wings to trip substantially simultaneously, then the snow shields on the two wings may contact or interfere with one another when the cutting edges both pivot. This interference may prevent the cutting edges from tripping properly and/or can result in damage to the cutting edges or even to the moldboard.

SUMMARY

The present disclosure is directed to a V-shaped snowplow blade (V-blade) that has a cutting edge which, together with a lower part of the moldboard, will trip when the blade strikes an obstacle on the roadway or on the sidewalk. In one embodiment, the blade is an adjustable, multi-position V-shaped snowplow blade. The cutting edge and lower section of the moldboard form a trip edge that will pivot when tripped and will translate laterally if both trip edges are tripped and the snow shields thereof start impinging upon each other, i.e., coming into contact with one another. In particular, the cutting edge and lower part of the moldboard will move laterally along a horizontal axis in a direction moving away from the central hinge about which the left wing and right wing are pivotable. If both the left wing and right wing strike an obstacle and trip substantially simultaneously, the disclosed configuration of the snowplow blade will substantially prevent interference between the shields on the left wing and right wing and therefore reduce the likelihood of damage to the cutting edges, the shields, and the moldboards of the two wings.

A V-blade for a snowplow, a snowplow incorporating the V-blade and a method of use thereof are disclosed herein. The blade includes left and right wings. A trip edge is provided on each wing and includes a lower section of moldboard, a cutting edge, and a snow shield. The trip edge is engaged with an upper section of the moldboard via a biasing assembly. The assembly biases the trip edge into alignment with the upper section for use. When an obstacle on the surface is struck by the trip edge, the trip edge pivots relative to the upper section about a horizontal axis extending along a shaft of the biasing assembly. A translation assembly causes the trip edge to move linearly and laterally away from a central shaft interposed between the left wing and the right wing. After the trip event, the trip edge returns to its original position under spring force.

In one aspect, an exemplary embodiment of the present disclosure may provide a V-blade for a snowplow comprising a left wing and a right wing; wherein each of the left wing and right wing includes a moldboard, a trip edge pivotable relative to the moldboard about a horizontal axis; a biasing assembly biasing the trip edge into alignment with the moldboard; and a translation assembly that translates the trip edge laterally in a first direction that is parallel to the horizontal axis when the trip edge pivots out of alignment with the moldboard.

In another aspect, an exemplary embodiment of the present disclosure may provide a snowplow comprising a vehicle; a V-blade; and a hitch assembly securing the V-blade to the snowplow and actuatable to manipulate the V-blade; wherein the V-blade comprises a left wing and a right wing; wherein each of the left wing and right wing includes a moldboard; a trip edge pivotable relative to the moldboard about a horizontal axis; a biasing assembly biasing the trip edge into alignment with the moldboard; and a translation assembly that translates the trip edge laterally in a first direction parallel to the horizontal axis when the trip edge pivots out of alignment with the moldboard.

In another aspect, an exemplary embodiment of the present disclosure may provide a method of preventing damage to a V-blade of a snowplow comprising providing a trip edge on a moldboard of each of a left wing and a right wing of the V-blade; biasing the trip edge into alignment with the moldboard with a biasing assembly; pivoting the trip edge relative to the moldboard about a horizontal axis when the trip edge impacts an obstacle on the surface along which the blade is traveling; and translating the trip edge laterally in a first direction relative to the moldboard and parallel to the horizontal axis.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
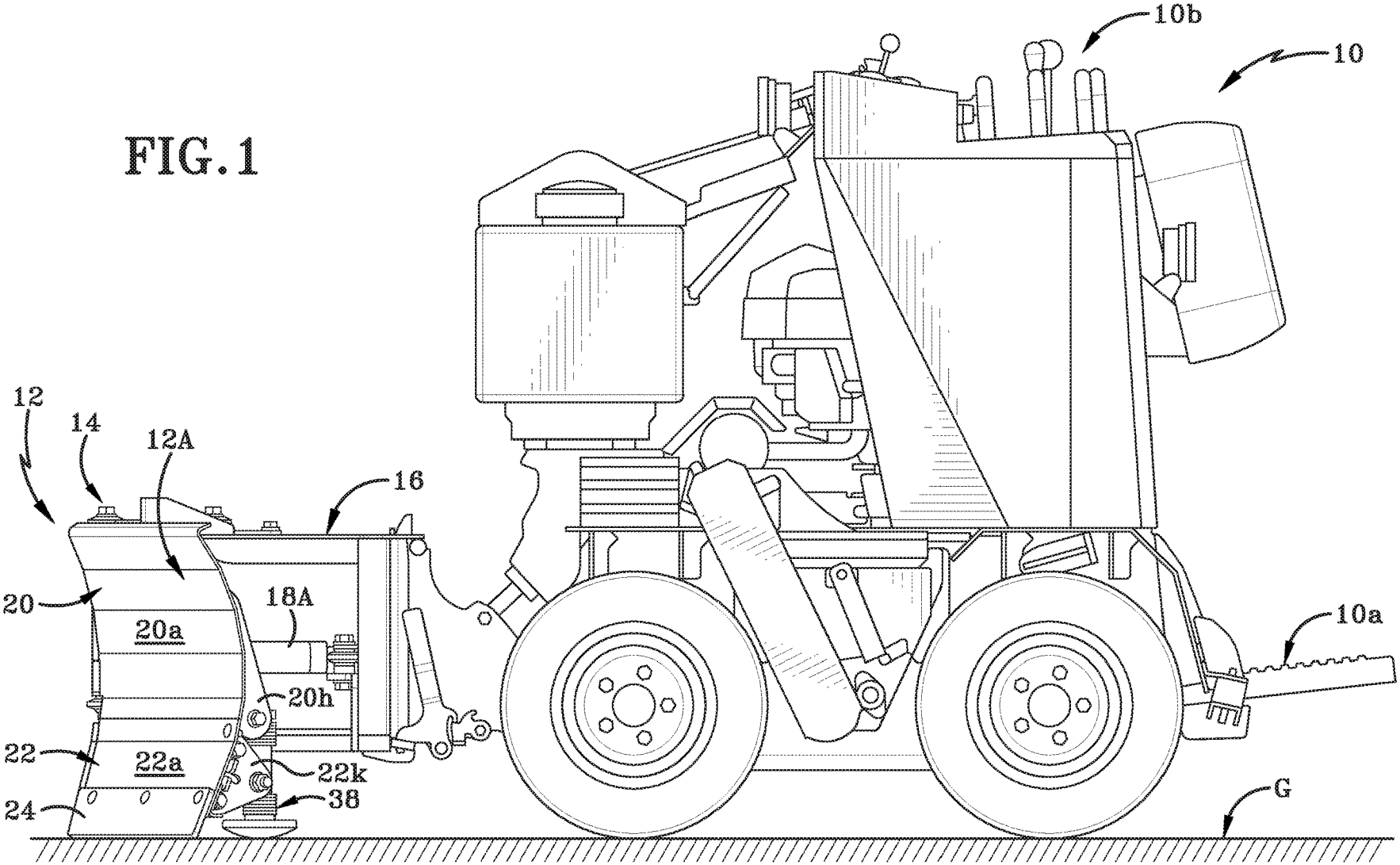
FIG. 1 is a left side elevation view of a snowplow comprising a utility vehicle upon which is mounted a V-shaped blade in accordance with the present disclosure.

FIG. 1 shows a utility vehicle 10 upon which is mounted a snowplow blade in accordance with the present disclosure, generally indicated at 12. As illustrated, the vehicle 10 includes a platform 10*a* upon which an operator will stand. Vehicle 10 also includes a control panel 10*b* that the operator uses to control the vehicle 10 and blade 12. Utility vehicle 10 is illustrated as a relatively small vehicle that may be used by a landscaping company or an individual to maintain driveways, sidewalks, and smaller surfaces that need to be cleared of snow but might require the vehicle to move in tight spaces. It will be understood that utility vehicle 10 is exemplary only and may be any vehicle that is capable of being used in winter conditions. It will be understood that if the vehicle 10 is a larger truck, the snowplow blade 12 may be fabricated to be of a size suitable for use therewith and that in such instances, the vehicle 10 and blade 12 may be utilized to clear snow from roadways, parking lots, and other larger surfaces.

Figure 2:
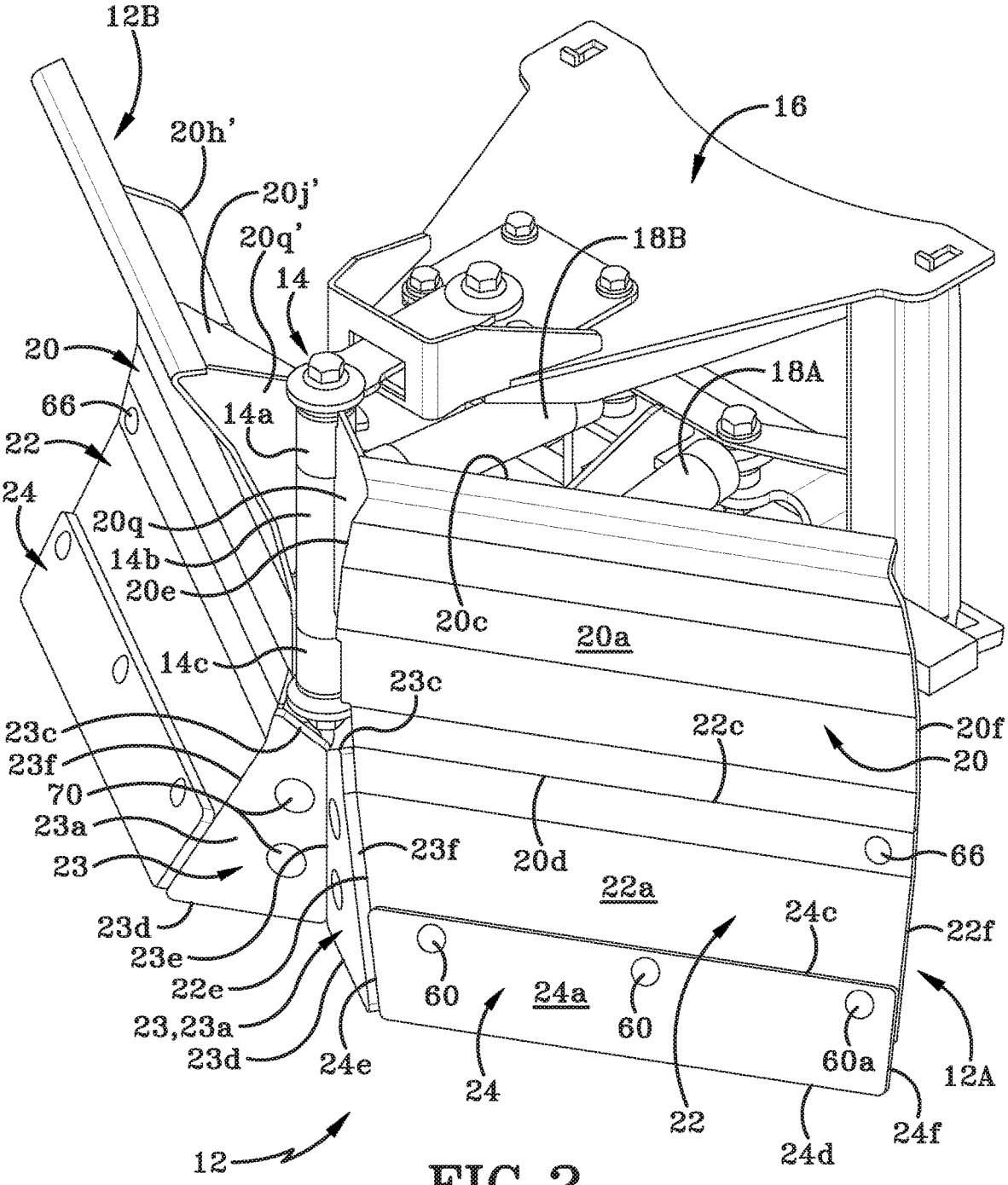
FIG. 2 is a front, top, left, isometric perspective view of the blade of FIG. 1 in accordance with the present disclosure shown on its own.

FIG. 2 shows snowplow blade 12 on its own. Blade 12 is a V-shaped snowplow blade. In the embodiment illustrated in the attached figures, the blade 12 is an adjustable snowplow blade that may be reconfigured to present different snow-clearing profiles as the conditions require. The blade 12 may therefore be referred to as a multi-position V-blade. The adjustability of blade 12 will be discussed later herein. Blade 12 comprises a left wing 12A and a right wing 12B that are each operably engaged with a central hinge 14. Each of the left wing 12A and right wing 12A may be individually pivoted about a vertical axis "Y" (FIGS. 3 and 4) that extends along a shaft (not shown) of central hinge 14. The vertical axis "Y" is a central vertical axis about which the left and right wings 12A and 12B are rotated to shift the multi-position blade from one configuration to another.

A hitch assembly 16 is operably engaged with left wing 12A, right wing 12B, and central hinge 14. Hitch assembly 16 is utilized to secure blade 12 to utility vehicle 10 and is operable to raise, lower, and reconfigure blade 12. Hitch assembly 16 as illustrated is exemplary only and it should be understood that any other suitable type of hitch assembly may be utilized to secure blade 12 to utility vehicle 10 and to permit operation of blade 12. Hitch assembly 16 will therefore not be described in any detail herein. One suitable hitch assembly for operatively engaging the blade 12 to utility vehicle 10 is disclosed in a copending patent application assigned to the present Assignee, Venture Products, Inc. That copending patent application is U.S. patent application Ser. No. 16/150,873, filed Oct. 3, 2018, entitled "Unique Attachment Assembly and Method of Use". The entire disclosure of this copending application is incorporated herein by reference.

Figure 3:
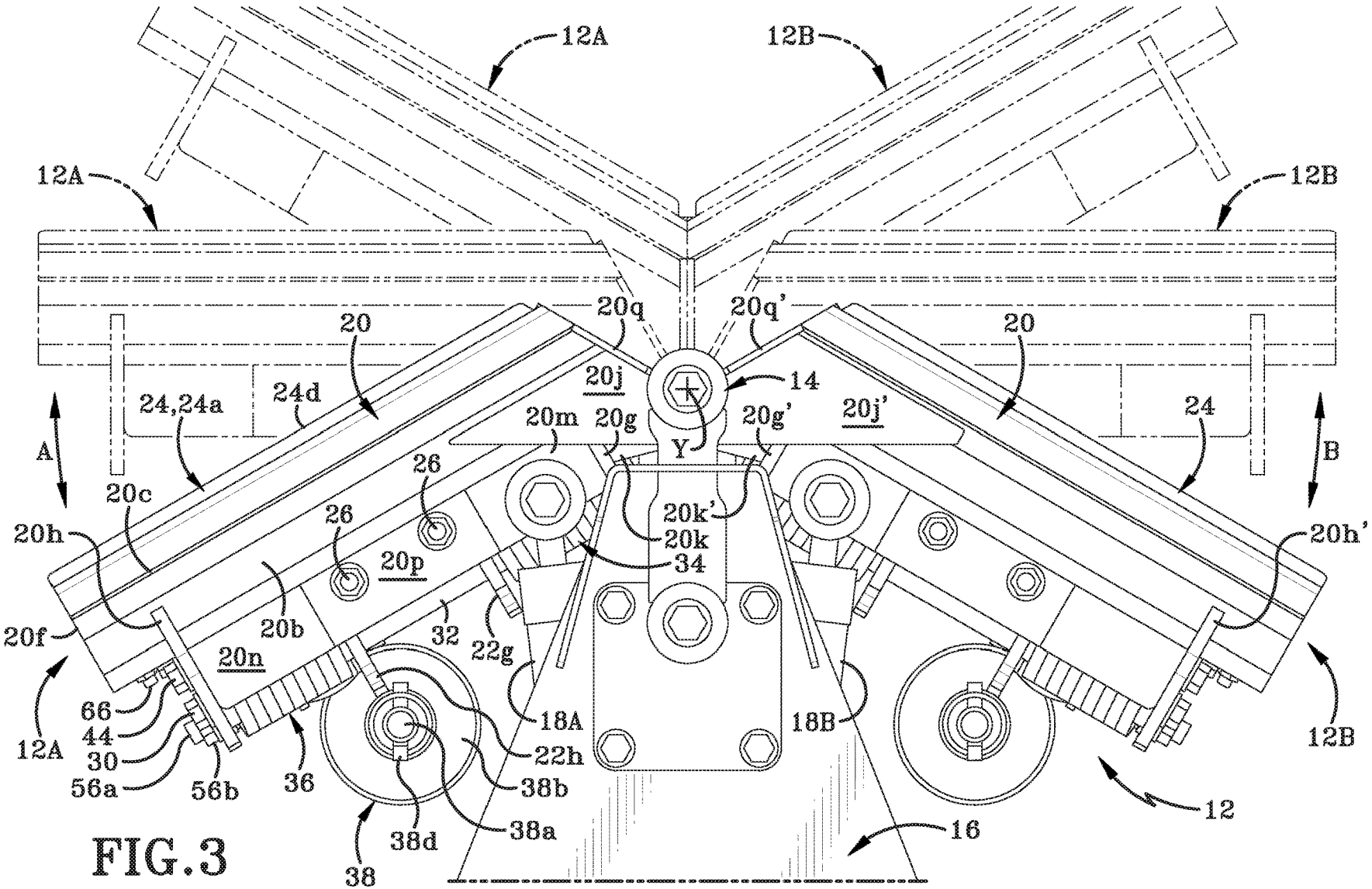
FIG. 3 is a top plan view of the blade of FIG. 2 illustrating the adjustability of the blade.

As best seen in FIG. 3, a first cylinder 18A of hitch assembly 16 operably engages left wing 12A to hitch assembly 16 and a second cylinder 18B operably engages right wing 12B to hitch assembly 16. First and second cylinders 18A, 18B may be hydraulic cylinders that are operatively linked to the hydraulic system of vehicle 10 or are engaged with a separate hydraulic system provided on vehicle 10. Alternatively, first and second cylinders 18A, 18B may be pneumatic cylinders that are operatively linked to a pneumatic system of vehicle 10 or are engaged with a separate pneumatic system provided on vehicle 10. Alternatively, first and second cylinders 18A, 18B may be electrically actuated.

First and second cylinders 18A, 18B are separately operable from vehicle 10 to pivot the associated left wing 12A and right wing 12B about the vertical axis "Y" (FIGS. 3 and 4) extending along central hinge 14. First cylinder 18A is operable to pivot left wing 12A about vertical axis "Y" as indicated by the arrows "A" in FIG. 3. Similarly, second cylinder 18B is operable to pivot right wing 12B about vertical axis "Y" as indicated by the arrows "B" in FIG. 3. By selectively pivoting left wing 12A and right wing 12B, snowplow blade 12 can be configured to be generally an inverted V-shape when viewed from above from vehicle 10 as shown in solid lines in FIG. 3. Snowplow blade 12 can also be configured so that the left wing 12A and right wing 12B are aligned in a same plane. In this instance, the blade 12 assumes the same shape as a straight snowplow blade, as is shown in phantom in FIG. 3. Left wing 12A and right wing 12B may further be reconfigured to generally assume a V-shape when viewed from above from the vehicle 10, as further shown in phantom in FIG. 3. Still further, each of the left wing 12A and right wing 12B is able to be positioned anywhere between the generally inverted V-shape and the V-shape. Consequently, the snowplow blade 12 is selectively manipulated to assume a variety of different configurations to best enable the device to remove snow from different surfaces.

Left wing 12A and right wing 12B are substantially identical in structure and function and are engaged with central hinge 14 as mirror images of one another. The following description is directed to left wing 12A but it will be understood that the description applies equally to right wing 12B. Differences between the left wing 12A and right wing 12B will be pointed out.

Referring mainly to FIGS. 2 to 8 and 11A, left wing 12A of blade 12 comprises a moldboard which includes an upper section 20 and a lower section 22, a shield 23 (also referred to herein as a snow shield 23), and a cutting edge 24. The shield 23 may also be referred to herein as a snow shield. The cutting edge 24 may also be referred to herein as a wear board or wear blade. Shield 23 and cutting edge 24 are operatively engaged with lower section 22 of the moldboard.

Lower section 22, shield 23, and cutting edge 24, together, form a trip edge that has a first degree of freedom and a second degree of freedom. The trip edge, when tripped is able to pivot about a horizontal axis "X" (FIG. 5) relative to upper section 20 of moldboard. This movement is the first degree of freedom of the trip edge. The consequence of pivoting about the horizontal axis "X" is that contact is broken between blade 12 and the surface "G" over which the blade 12 is traveling and from which it is removing snow.

The trip edge 22, 23, 24 is also able to translate linearly in a direction parallel to the horizontal axis "X". This movement is the second degree of freedom of the trip edge. The linear translation of the trip edges occurs when the blade 12 is in a V-shape and encounters an obstruction "G1" in the surface, causing the trip edges to trip and pivot. When the blade 12 is in the V-shape and trips, as the trip edges begin to pivot, a gap between the lower sections 22, snow shields 23, and cutting edges 24 on the two wings 12A, 12B tends to narrow. As the trip edges continue to pivot, the sides thereof that are in closest proximity to each other, i.e., the snow shields 23, may begin to contact each other. This contact may interfere with the pivotal motion of the trip edges of the two wings 12A, 12B and may also cause damage to the lower sections 22, snow shields 23, and/or cutting edges 24. In response to the contact, the snow shields 23 each act as a cam, pushing the trip edges linearly away from each other. In particular, the trip edge 22, 23, 24 of the left wing 12A will translate laterally and horizontally away from the trip edge 22, 23, 24 of the right wing 12B; with both trip edges moving in a direction parallel to the horizontal axis "X" about which the particular trip edge is pivoting. The consequence of each trip edge moving linearly away from the other is that the trip edges momentarily break contact with one another. In particular, the lateral translation of the trip edges momentarily breaks contact between the snow shields 23 of the two wings 12A, 12B and allows the trip edges to continue to pivot without interfering with each other.

Figure 9:
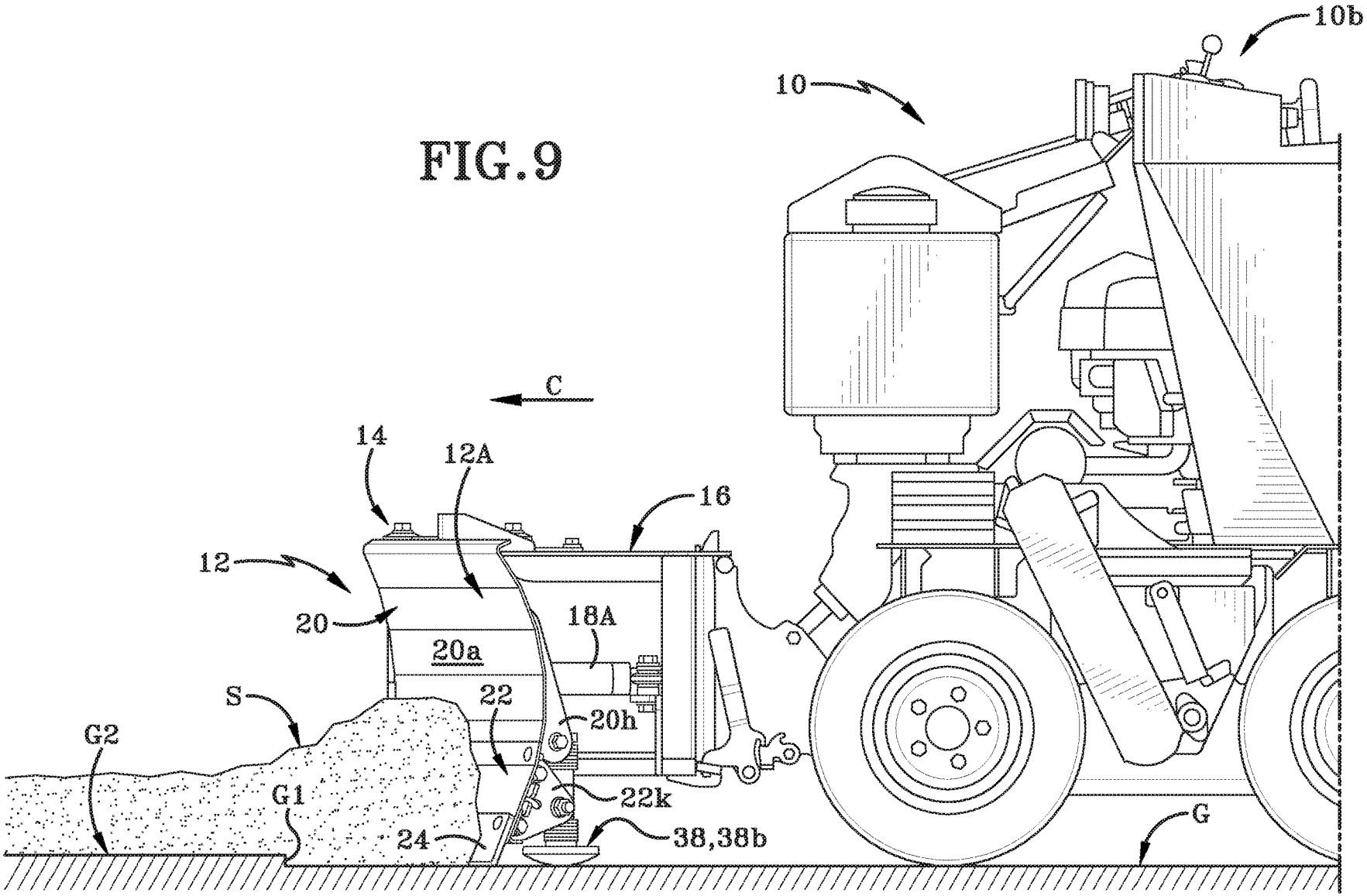
FIG. 9 is a partial left side elevation view of the snowplow in use and showing the blade traveling along a surface removing snow, and further showing a solid obstacle a distance in front of the blade.

The various components of blade 12 will now be described in greater detail. The upper section 20 and lower section 22 are fabricated from the same material. Suitable materials include steel or stainless steel. It is not contemplated that the lower section 22 will contact the surface "G" (FIG. 9) over which the V-blade 12 is traveling. The cutting edge 24 is contemplated to always be the component of the V-blade 12 that contacts the surface "G". Cutting edge 24 typically is fabricated from a different material from that of upper section 20 and lower section 22. In one embodiment, the cutting edge 24 is fabricated from a less expensive and less durable material than upper section 20 and lower section 22 such as urethane or a less expensive steel. Since snow shield 23 also contacts the surface "G", snow shield 23 may tend to wear away over time through contact with surface "G". For this reason, snow shield 23 may be fabricated from the same material or a similar material to cutting edge 24.

As shown in FIG. 2, upper section 20 of the moldboard is a generally concavely-curved component having a front surface 20*a*, a rear surface 20*b* (FIG. 4), a top edge 20*c*, a bottom edge 20*d* (FIG. 11A), a first side 20*e*, and a second side 20*f*. A first plate 20*g* (FIG. 4) and a second plate 20*h* extend rearwardly from the rear surface 20*b*. First plate 20*g* and second plate 20*h* are vertically oriented and extend outwardly from rear surface 20*b*, generally at right angles thereto. First plate 20*g* is located a distance inwardly from first side 20*e* and second plate 20*h* is located a distance inwardly from second side 20*f*. First and second plates 20*g*, 20*h* are laterally spaced a distance apart from one another. Plates 20*g*, 20*h* originate a distance downwardly from top edge 20*c*. A leading portion of each plate 20*g*, 20*h* terminates proximate bottom edge 20*d*. A trailing portion of each plate 20*g*, 20*h* extends downwardly for a distance below bottom edge 20*d* of upper section 20, as can best be seen in FIG. 11A. With this arrangement, the trailing portion of each plate 20*g*, 20*h* overlaps part of the lower section 22 of the moldboard of left wing 12A but is not secured thereto.

Upper section 20 of the moldboard also includes a number of horizontally-oriented plates. A first plate 20*j* (FIG. 4) and a second plate 20*k*, which are horizontally-oriented, extend between second plate 20*g* and central hinge 14. First plate 20*j* is located a distance vertically above second plate 20*k*. Central hinge 14 includes the vertical shaft (not shown) referred to earlier herein, and further includes an upper sleeve 14*a*, a middle sleeve 14*b*, and a lower sleeve 14*c* that circumscribe the vertical shaft. (The vertical axis "Y" about which left wing 12A and right wing 12B pivot extends along this shaft of central hinge 14.) Upper sleeve 14*a* and lower sleeve 14*c* are welded to right wing 12B and middle sleeve 14*b* is welded to left wing 12A. In particular, first plate 20*j* and second plate 20*k* are welded to middle sleeve 14*b* of central hinge 14.

It should be noted that second wing 12B also has two vertically oriented plates 20*g*' and 20*h*'. Second plate 20*h*' is substantially identical in structure to second vertical plate 20*h* of first wing 12A. First plate 20*g*' is longer than first plate 20*g* but other than that, is substantially identical in structure to first plate 20*g*. Second wing 12B also includes two horizontally oriented plates 20*j*' and 20*k*' that extend between first plate 20*g*' and central hinge 14. In particular, first plate 20*j*' is welded to upper sleeve 14*a* of central hinge 14. Second plate 20*k*' is welded to lower sleeve 14*c* of central hinge 14. The arrangement of the engagement of left wing 12A, right wing 12B, and central hinge 14 enables left and right wings 12A, 12B to be individually pivoted about central hinge 14 and relative to one another when actuated by cylinders 18A and 18B, respectively.

It will be understood that in other embodiments the arrangement of the vertically-oriented first and second plates 20*g*, 20*h* and the horizontally-oriented first and second plates 20*j*, 20*k* of left wing 12A may, instead, be provided on right wing 12B; and the vertically-oriented first and second plates 20*g*', 20*h*' and horizontally-oriented first and second plates 20*j*', 20*k*' of right wing 12B may, instead, be provided on left wing 12A.

Left wing 12A further include an additional generally U-shaped plate that extends between first and second plates 20*g*, 20*h*. The additional plate includes a horizontally oriented first plate section 20*m* and second plate section 20*n* that are coplanar and are welded to their respective first and second plates 20*g*, 20*h*. A third plate section 20*p* is interposed between first and second plate sections 20*m*, 20*n* but is located a distance vertically below first and second plates sections 20*m*, 20*n*. Third plate section 20*p* connects to first and second plate sections 20*m* by vertical arms (not numbered). The plate sections 20*m*, 20*n*, 20*p* are welded to back surface 20*b* of upper section 20.

FIGS. 2 and 3 show that a first side plate 20*q* is welded to first side 20*e* of left wing 12A proximate top edge 20*c* thereof. Similarly, a first side plate 20*q*' is welded to first side 20*e* of right wing 12A proximate the top edge thereof. The first side plates 20*q* and 20*q*' flank central hinge 14 and are positioned forwardly of the first plates 20*j*, 20*j*'. First side plates 20*q*, 20*q*' aid in preventing snow that rides up the moldboard from becoming wedged between central hinge 14 and the left and right wings 12A, 12B.

Figure 4:
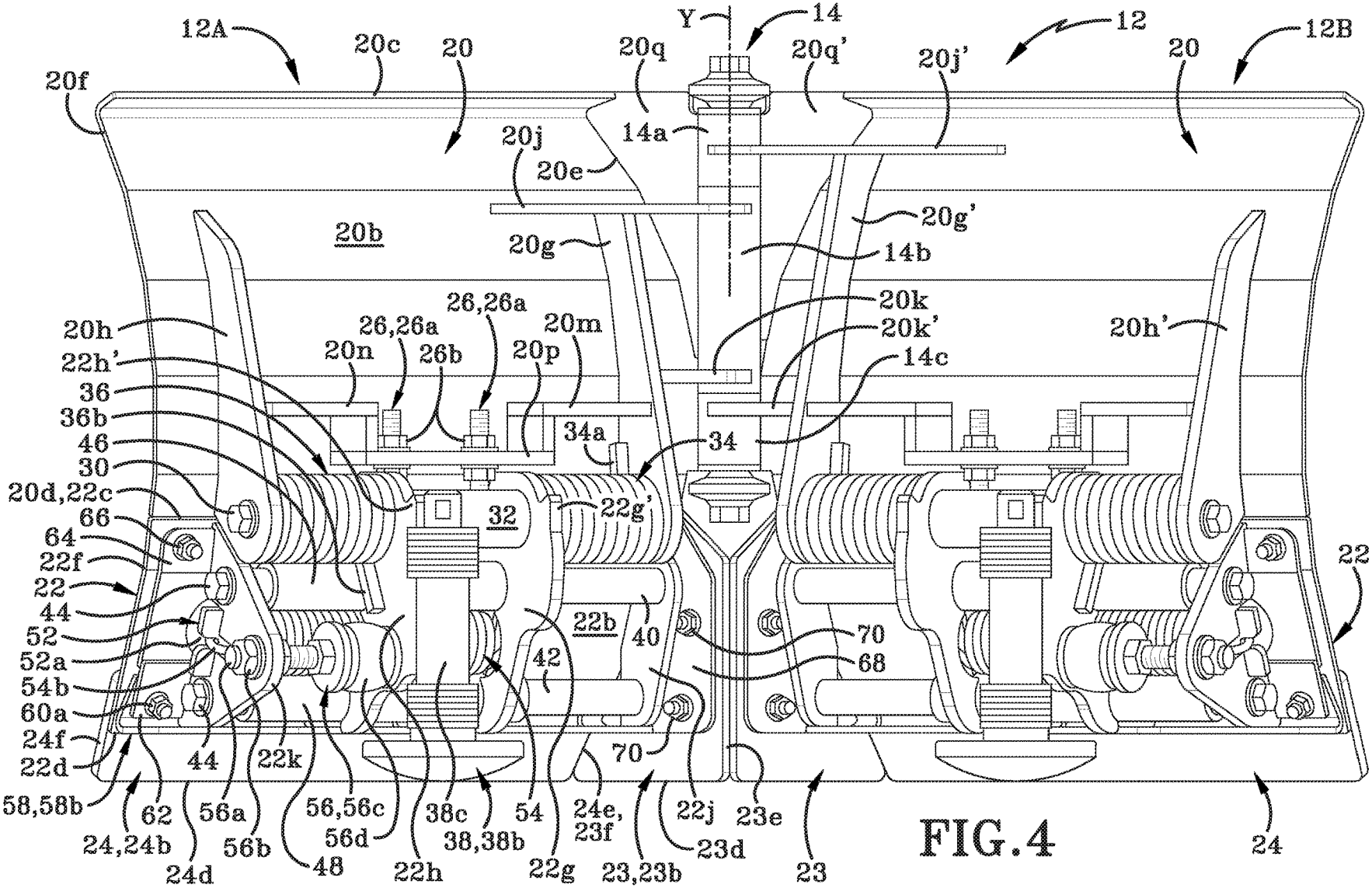
FIG. 4 is a rear elevation view of the blade with the hitch assembly omitted for clarity of illustration.
Figure 8:
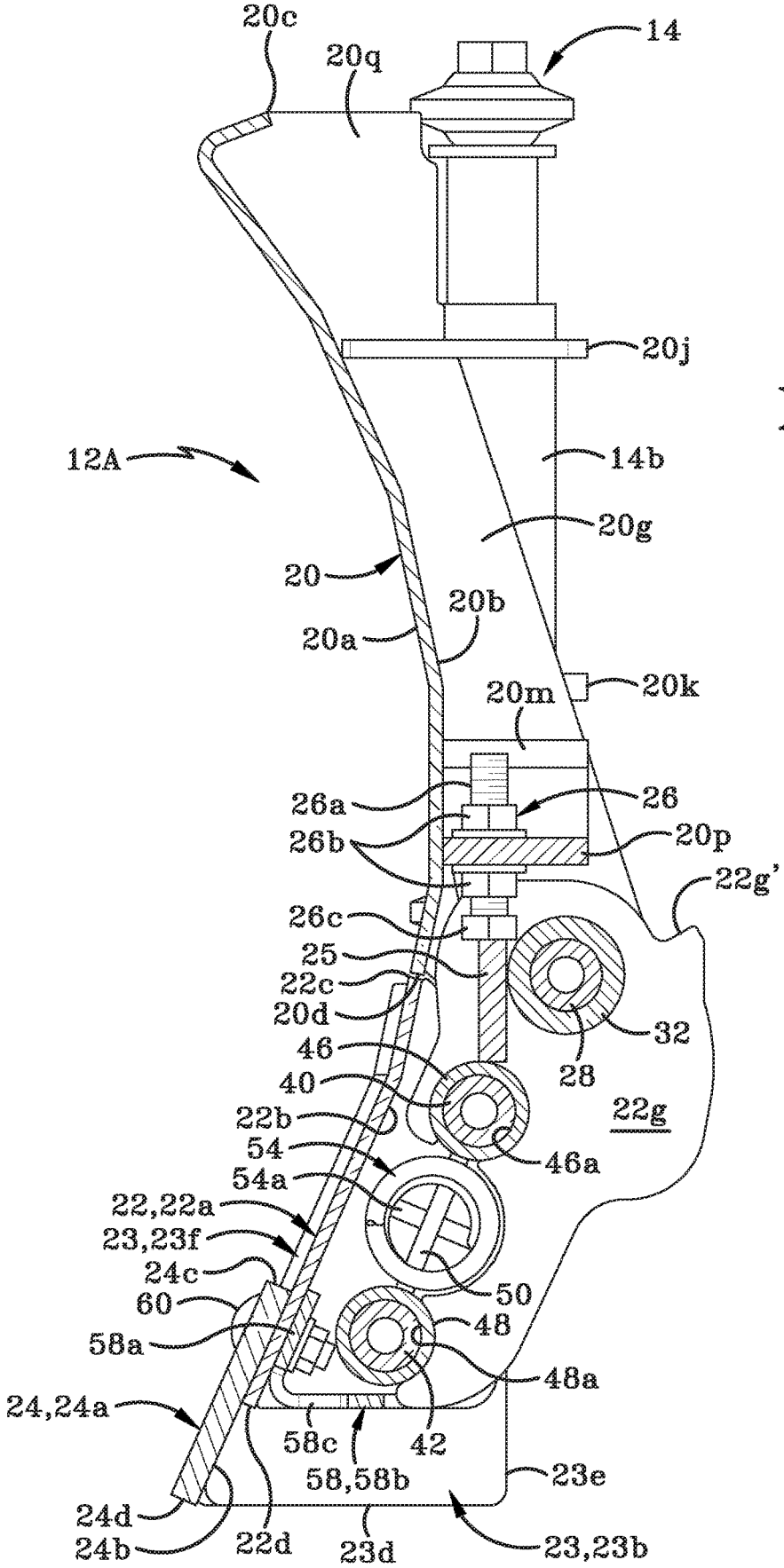
FIG. 8 is a cross-section through the left wing of the blade taken along line 8-8 of FIG. 5.

Referring to FIGS. 4 and 8, one or more adjustment screws 26 are provided on third plate section 20*p*. As illustrated, a pair of adjustment screws 26 are provided on third plate section 20*p* with the screws 26 being laterally spaced a distance apart from one another. Each screw 26 comprises a threaded rod 26*a* (FIG. 8) that passes through an aperture (not shown) defined in third plate section 20*p*. A fastener 26*b* is operatively engaged with rod 26*a* on both sides of third plate section 20*p*. The fastener 26*b* holds rod 26*a* in engagement with third plate section 20*p*. A nut 26*c* is threadedly engaged with the lower end of rod 26*a*. The length of rod 26*a* that extends below a bottom surface of third plate section 20*p* is selectively changed to set a position of nut 26*c* relative to third plate section 20*p*. The adjustment in the length of rod 26*a* is undertaken by rotating the fastener 26*b* in one of a first direction or a second direction. The purpose of these adjustment screws 26 will be described later herein.

Figure 5:
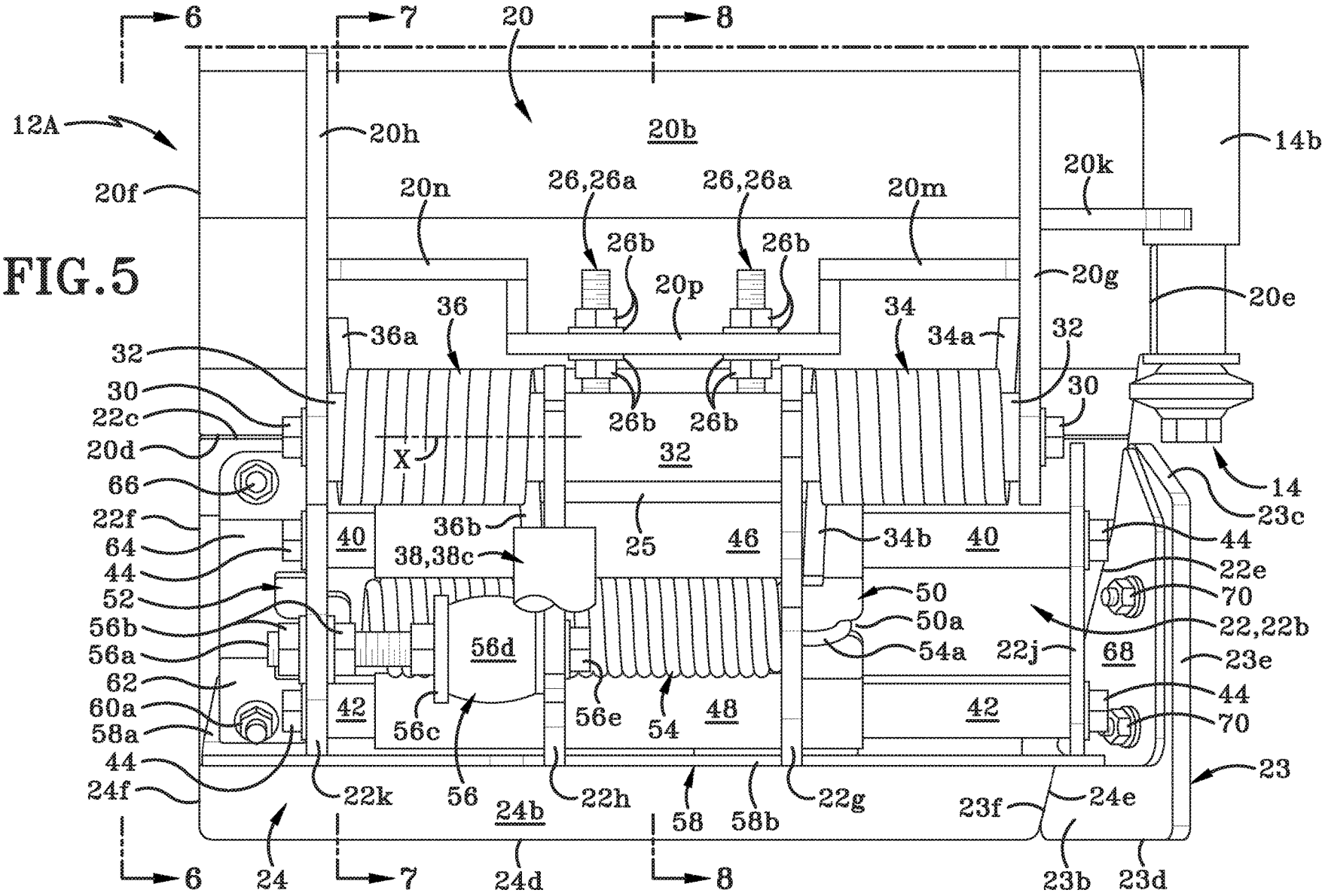
FIG. 5 is a partial rear elevation view of the left wing of the blade with the skid shoe partially removed for clarity of illustration.
Figure 6:
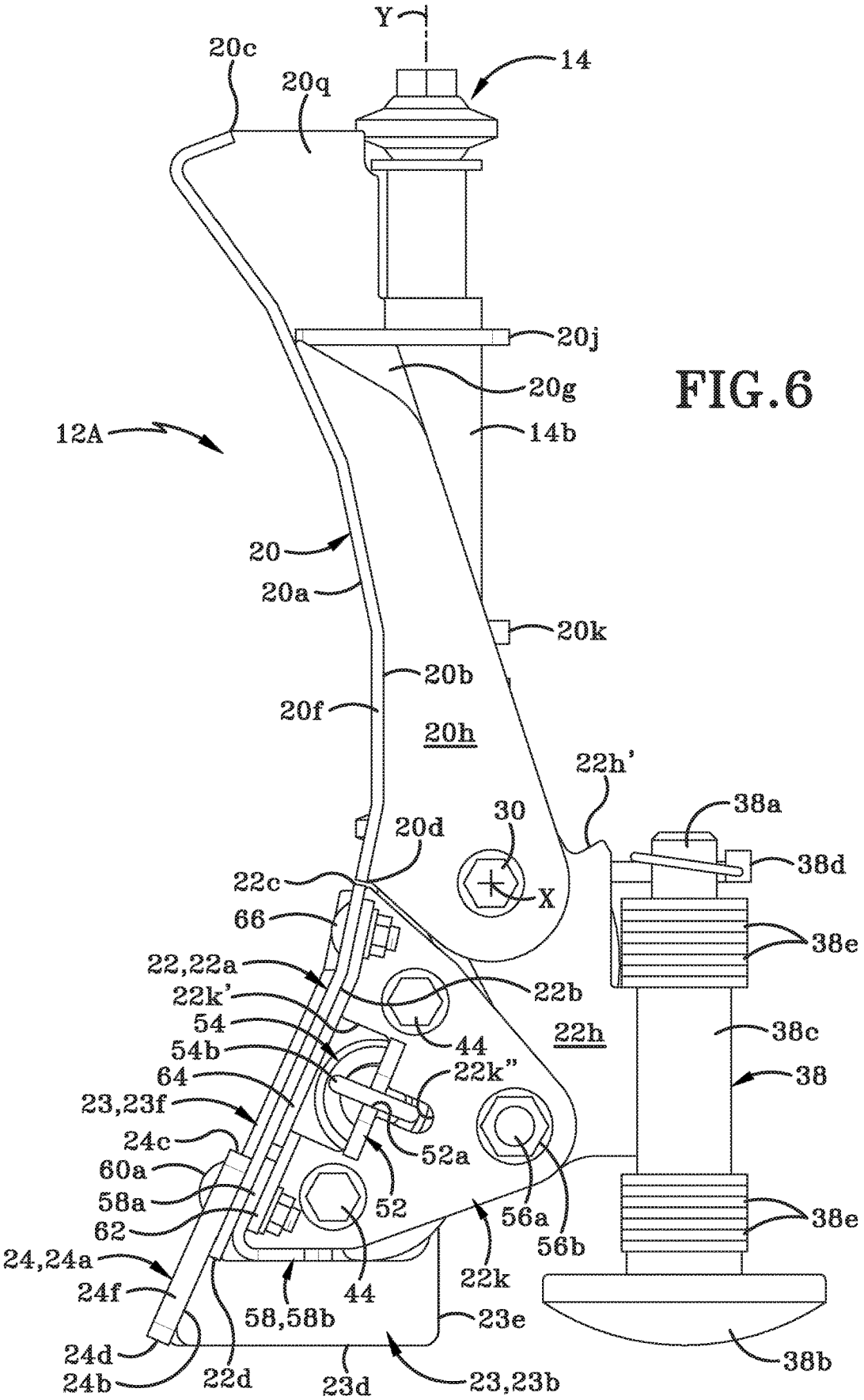
FIG. 6 is a left side elevation view of the left wing of the blade taken along line 6-6 of FIG. 5.

Referring still to FIGS. 2 to 8, 11A and 11B, lower section 22 is a generally rectangular member that is substantially concavely-curved when viewed from the left side, as in FIG. 6. When V-blade 12 is in an untripped condition, such as is illustrated in FIG. 6, the concave curvature of lower section 22 of the moldboard generally follows the radius of curvature of the upper section 20 thereof. Lower section 22 has a front surface 22*a*, a rear surface 22*b* (FIG. 4), a top edge 22*c* (FIG. 11B), a bottom edge 22*d* (FIG. 11A), a first side 22*e* (FIG. 11B), and a second side 22*f*.

A first bracket 22*g* (FIG. 4) and a second bracket 22*h* extend rearwardly from the rear surface 22*b* of the lower section 22, are vertically oriented, and are laterally spaced from one another. Each bracket 22*g*, 22*h* extends generally from proximate top edge 22*c* of lower section 22 to proximate bottom edge 22*d* thereof. First and second brackets 22*g*, 22*h* are positioned vertically below third plate section 20*p* of upper section 20. First and second brackets 22*g*, 22*h* are located a distance outwardly from adjustment screws 26 on upper section 20. A connector plate 25 (FIGS. 5 and 8) extends between the inner surfaces of first and second brackets 22*g*, 22*h* and is located a distance vertically downward from an upper edge of each of the first and second brackets 22*g*, 22*h*. As best seen in FIG. 8, connector plate 25 is vertically aligned with the threaded rod 26*a* of adjustment screws 26. Adjustment screws 26 are adjusted to position nut 26*c* in contact with an upper surface of connector plate 25. The purpose of this arrangement will be described later herein.

Each of first wing 12A and second wing 12B of blade 12 is provided with a biasing assembly that urges the lower section 22 of the associated wing into alignment with the upper section 22 thereof. Stated otherwise, the biasing assembly urges the trip edge into alignment with the upper section 22 of the moldboard. In the illustrated embodiment, the biasing assembly is a spring assembly, particularly a torsion spring assembly. It will be understood that in other embodiments, other types of biasing assembly or biasing mechanisms may be utilized instead of the illustrated torsion spring assembly. Any suitable mechanisms may be utilized that perform this same biasing function as the illustrated torsion spring assembly.

Figure 7:
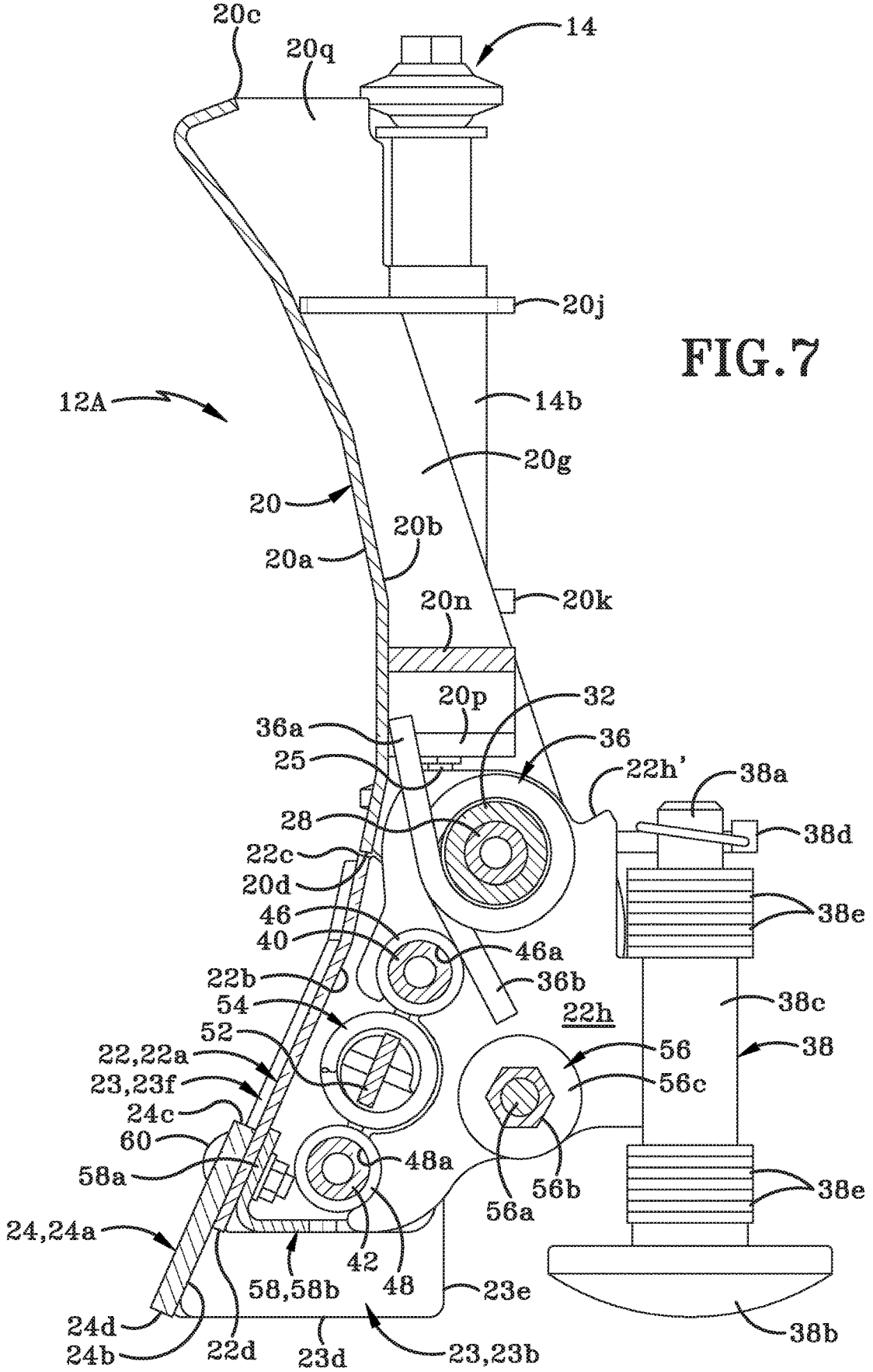
FIG. 7 is a cross-section through the left wing of the blade taken along line 7-7 of FIG. 5.

The illustrated torsion spring assembly includes a shaft 28 (FIG. 7), fasteners 30, a sleeve 32, and one or more torsion springs. In particular, the torsion spring assembly as illustrated herein includes a first torsion spring 34 and a second torsion spring. An aperture (not shown) is defined in each of the first and second plates 20*g*, 20*h* of upper section 20 and a hole (not shown) is defined in each of the first and second brackets 22*g*, 22*h*. The apertures and holes are laterally aligned with one another and the shaft 28 of the torsion spring assembly extends therethrough. Bolts 30 secure shaft 28 to first and second plates 20*g*, 20*h*. A first sleeve 32 circumscribes shaft 28. The first torsion spring 34 and second torsion spring 36 are arranged to circumscribe first sleeve 32. First torsion spring 34 is located between first vertical plate 20*g* and first bracket 22*g*. Second torsion spring 36 is located between second vertical plate 20*h* and second bracket 22*h*. As shown in FIGS. 5 and 8, first torsion spring 34 has a first end 34*a* that abuts rear surface 20*b* of upper section 20 and a second end 34*b* that abuts part of lower section 22, as will be described later herein. Similarly, as shown in FIGS. 5 and 7, second torsion spring 36 has a first end 36*a* that abuts rear surface 20*b* of upper section 20 and a second end 36*b* that abuts part of lower section 22 as will be described later herein. The spring force applied by torsion spring assembly to keep the trip edge aligned with the upper section 20 of the moldboard is sufficient to ensure that the blade 12 is capable of clearing snow from the surface "G" without the trip edge tripping. The trip edge will only trip when blade 12 encounters an obstacle "G1" of a sufficient size that the impact therewith overcomes the spring force provided by the torsion spring assembly.

Referring to FIGS. 1 and 6, left wing 12A includes a skid shoe 38 that aids in keeping cutting edge 24 slightly off the surface "G" to be cleared. Skid shoe 38 is particularly useful when blade 12 is used to clear snow from gravel driveways or roadways. Skid shoe 38 is utilized to raise or lower the blade 12 relative to the surface "G". As best seen in FIG. 6, skid shoe 38 includes a central rod 38*a* that has an enlarged curved shoe 38*b* provided at a lower end thereof. Rod 38*a* passes through a central bore of a skid shoe mount 38*c* that is welded to the trailing edge of second bracket 22*h*. Shoe 38*b* is located below the skid shoe mount 38*c* and a section of rod 38*a* extends outwardly beyond an upper end of skid shoe mount 38*c*. Shoe 38*b* is of a greater diameter than the diameter of the central bore of skid shoe mount 38*c*. A through-hole (not shown) is defined in the section of rod 38*a* that extends outwardly beyond the upper end of skid shoe mount 38*c*. A pin 38*d* is removably inserted through the through-hole to prevent rod 38*a* from being withdrawn downwardly through skid shoe mount 38*c*.

A plurality of removable washers 38*e* is received around rod 38*a* in locations above and below skid shoe mount 38*c*. The operator of vehicle 10 is able to set the distance between shoe 38*b* and the lower end of skid shoe mount 38*c* by changing the number of washers 38*e* that are located between shoe 38*b* and the lower end of skid shoe mount 38*c*. As illustrated in FIG. 6, seven washers 38*e* are located below skid shoe mount 38*c* and eight washers 38*e* are located above skid shoe mount 38*c*. If the operator wishes to raise blade 12 off the ground to a greater extent, he or she will remove pin 38*d* and slide rod 38*a* downwardly and out of skid shoe mount 38*c*. An additional number of washers 38*e* that are illustrated as being located above skid shoe mount 38*c* in FIG. 6 will then be placed on top of the washers 38*e* which are located below skid shoe mount 38*c*. The rod 38*a* is then reinserted through the bore of skid shoe mount 38*c* and pin 38*d* will be reengaged in through-hole. Lowering the blade 12 will involve removing one or more washers 38*e* from below the skid shoe mount 38*c* and placing them above the skid shoe mount 38*c*. The ground-contacting surface of shoe 38*b* may be coated with a friction-reducing material to allow shoe 38*b* to slide relatively easily over surface "G". Because skid shoe 38 is engaged with second bracket 22*h*, skid shoe 38 will move in unison with lower section 22. In other words, skid shoe 38 will move in unison with the trip edge on blade 12.

A third bracket 22*j* and fourth bracket 22*k* extend outwardly from back surface 22*a* of lower section 22, are vertically oriented and located outwardly from first bracket 22*g* and second bracket 22*h*, respectively. Third bracket 22*j* is vertically offset from first plate 20*g* of upper section 20. As illustrated, in this embodiment, third bracket 22*j* is located a distance further outwardly from second side 22*f* than the distance between second side 20*f* and first plate 20*g*. Third bracket 22*j* is therefore laterally closer to central hinge 14 than first plate 20*g*. Fourth bracket 22*k* is generally vertically aligned with second plate 20*h* of upper section 20. As best seen in FIG. 6, the upper edge of the fourth bracket 22*k* is at least partially complementary in configuration to the lower edge of the second plate 20*h*.

Blade 12 is provided with a translation assembly that, when the trip edge is tripped, moves the trip edge laterally in a first direction parallel to the horizontal axis "X". The translation assembly includes at least one guide rod, at least one sleeve through which the at least one guide rod is received, and a coil spring 54. FIGS. 5, 7, and 8 show that left wing 12A includes a first guide rod 40 extending through a bore 46*a* of a first sleeve 46 and a second guide rod 42 extending through a bore 48*a* of a second sleeve 48. The first sleeve 46 therefore circumscribes the first guide rod 40 and the second sleeve 48 circumscribes the second guide rod 42. The first and second guide rods 40, 42 and first and second sleeves 46, 48 extend through aligned apertures or recesses in third bracket 22*j*, first bracket 22*g*, second bracket 22*h*, and fourth bracket 22*k*, respectively moving outwardly away from central hinge 14. Bolts 44 secure the guide rods 40, 42 to third bracket 22*j*, and fourth bracket 22*k*. First guide rod 40 and first sleeve 46 are located a distance vertically above and rearwardly of second guide rod 42 and second sleeve 48. First and second sleeves 46, 48 are shorter in length than the associated first and second guide rods 46, 48. As best seen in FIG. 5, a connector bracket 50 extends between a terminal region of first sleeve 46 and a terminal region of second sleeve 48. First and second sleeves 46, 48 and connector bracket 50 are welded to first and second brackets 22*g*, 22*h* and move in unison with upper section 20 of moldboard. Because first and second guide rods 40, 42 are fixedly engaged with third bracket 22*j* and fourth bracket 22*k*, the first and second guide rods 40, 42 move in unison with lower section 22 of moldboard. In particular, first and second guide rods 40, 42 are selectively axially movable through the bores 46*a*, 48*a* (FIGS. 7 and 8) of the associated first and second sleeves 46, 48, as lower section 22 translates in relation to upper section 20. This will be discussed later herein.

As indicated earlier herein, the torsion spring assembly includes first and second torsion springs 34, 36 that have first ends 34*a*, 36*a*, respectively, which contact the rear surface 20*b* of upper section 20. First and second torsion springs 34, 36, have second ends 34*b*, 36*b*, respectively, that contact a rear region of first sleeve 46, as shown in FIG. 7. The torsion springs 34, 36 apply a spring force to upper section 20 and lower section 22 and keep the two vertically aligned with one another. In particular, torsion springs 34, 36 urge lower section 22 into alignment with upper section 20.

Referring to FIGS. 4 and 6, fourth bracket 22*k* defines a recess 22*k*' therein that extends from an inner surface (opposite second bracket 22*h*) to an outer surface thereof. Recess 22*k*' is positioned between the bolts 44 that secure first and second rods 40, 42 to fourth bracket 22*k*. Recess 22*k*' originates in the leading edge of fourth bracket 22*k* and extends rearwardly and inwardly for a distance therefrom. A U-shaped slot 22*k*" (FIG. 6) extends further rearwardly and inwardly into fourth bracket 22*k* from where recess 22*k* terminates. A connector bracket 52 is welded to the fourth bracket 22*k* in such a way that at least a portion thereof extends outwardly at right angles to the outer surface of fourth bracket 22*k* and towards the second side 22*f* of lower section 22. Connector bracket 52 defines a slot 52*a* therein that is in communication with the slot 22*k*" of fourth bracket 22*k*. The coil spring 54 extends between connector bracket 50 and connector bracket 52. In particular, a first end 54*a* of coil spring 54 is received in slot 50*a* of connector bracket 50 and a second end 54*b* of coil spring 54 is received in slot 52*a* of connector bracket 52. When the operator sets the blade 12 to remove snow, the upper section 20 of the moldboard is held in a certain orientation to effect that snow removal. The lower section 22 of the moldboard (and the cutting edge 24 and snow shield 23) also remains in that same orientation unless and until an obstruction "G1" is encountered on the surface "G". The upper section 20 can be considered to effectively remain stationary in that particular set orientation selected by the operator. When an obstruction is encountered, and the trip edge trips, the trip edge translates horizontally but the upper section 20 remains stationary. Connector bracket 50 is welded to first bracket 22*g* and therefore will remain effectively stationary at all times. Connector bracket 52 is welded to fourth bracket 22*k* and therefore will translate horizontally with the lower section 22 when the trip edge is tripped. Since coil spring 54 has its first end engaged with a stationary connector bracket 50 and a second end engaged with a movable connector bracket 52, this arrangement causes the coil spring 54 to move from an at-rest condition to an expanded condition when the trip edge is tripped. In particular, the coil spring 54 increases from a first length to a second length when the trip edge is tripped. The coil spring 54 therefore stores up potential spring force by expanding.

It will be understood that in other embodiments, the components may be configured so that the coil spring becomes compressed when the trip edge is tripped and is therefore moved from the at rest condition to a compressed condition during a tripping event.

Figure 11A:
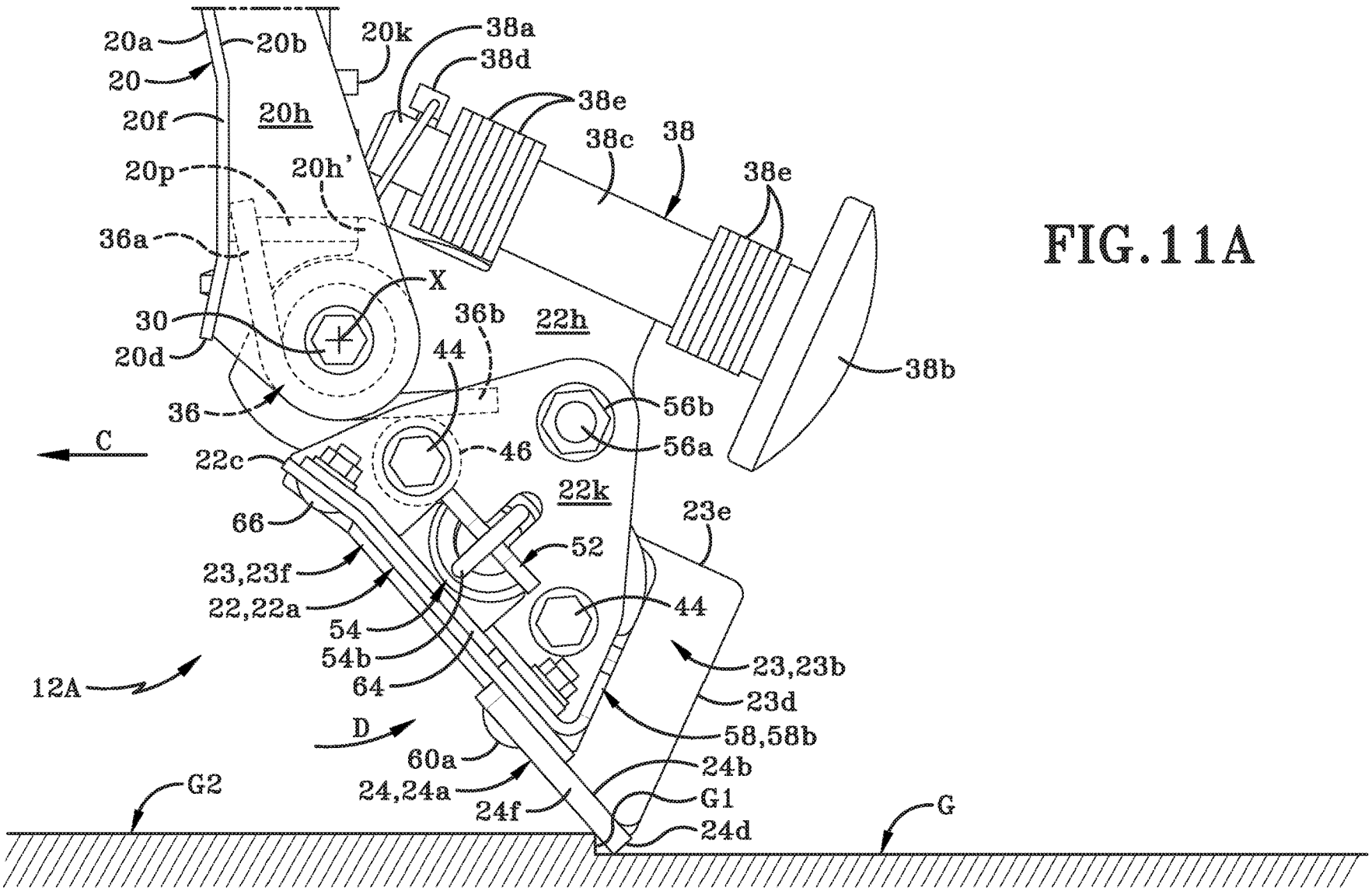
FIG. 11A is a partial left side elevation view showing the lower section of the blade tripping as it encounters the obstacle on the surface.
Figure 11B:
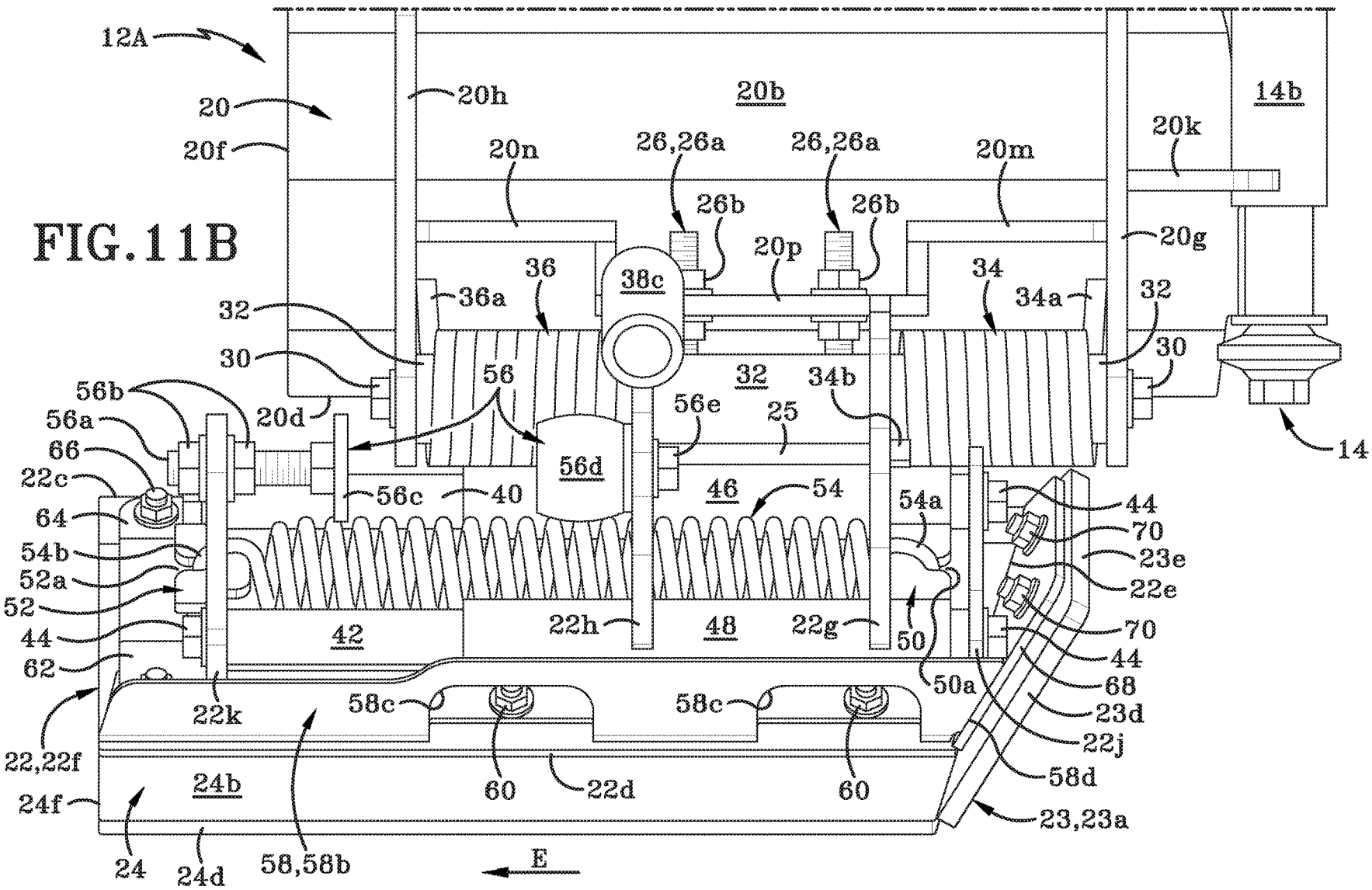
FIG. 11B is a rear elevation view of the blade shown in FIG. 11A with the skid shoe partially removed for clarity of illustration, and showing the lateral translation of the lower section of the blade relative to the upper section thereof.
Figure 12:
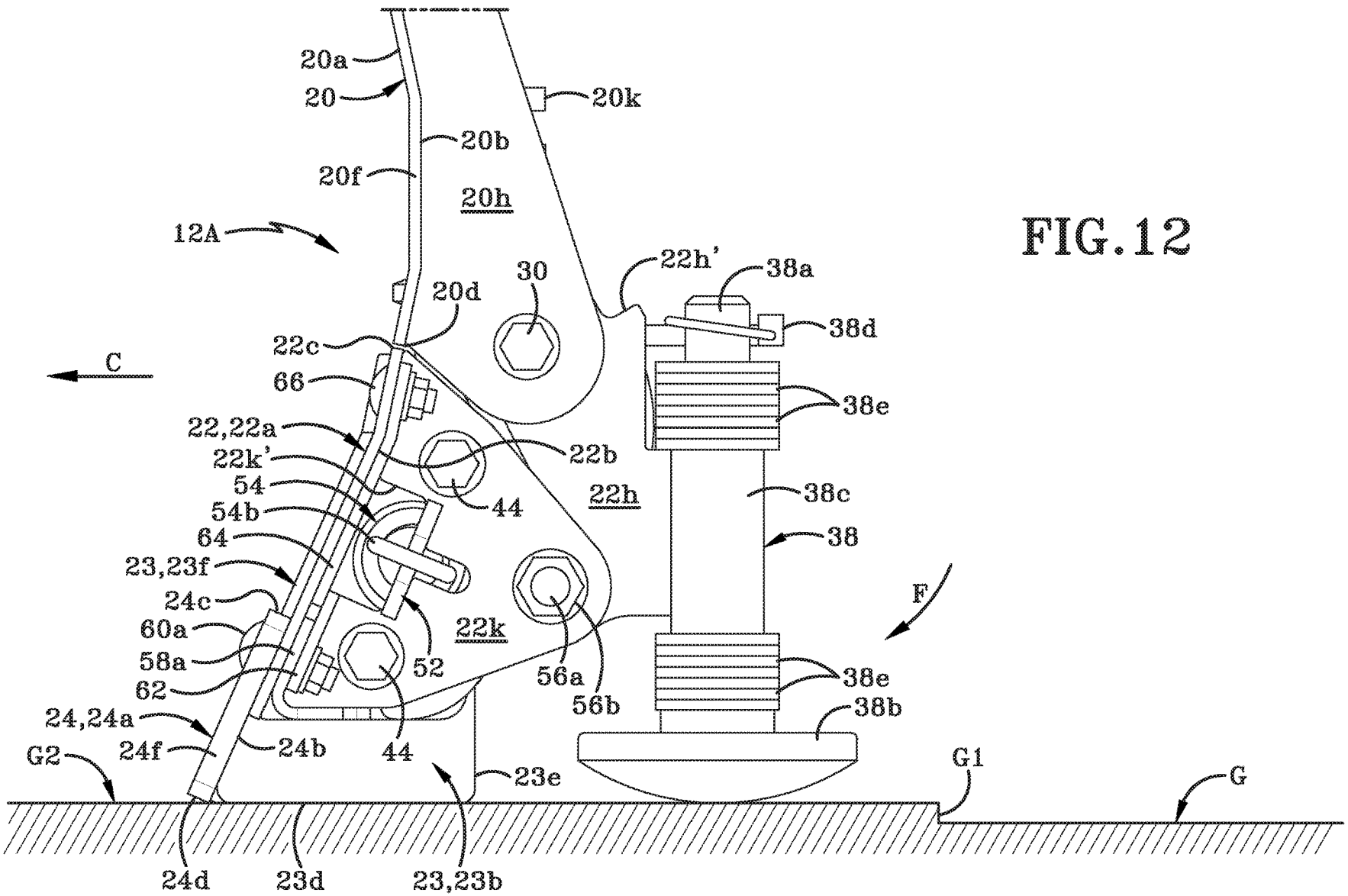
FIG. 12 is a partial left side elevation view of the lower section of the blade returning to its original position.

Referring to FIGS. 5, 7, and 11B, the translation assembly also includes a bumper system 56 that is provided on lower section 22 and is utilized to slow down and dampen the movement of the lower section 22 as it returns to its at rest position under force of coil spring 54. Bumper system 56 includes a threaded rod 56*a* which extends through an aperture defined in fourth bracket 22*k*. A fastener 56*b* secures rod 56*a* to fourth bracket 22*k*. As best seen in FIG. 11B, bumper system 56 also includes a stop plate 56*c* that is threadedly engaged with a first end of rod 56*a*. Bumper system 56 further includes a bumper 56*d* which is secured to second bracket 22*h* by a fastener 56*e*. Bumper 56*d* is fabricated from a resilient material that is suitable for damping the movement of lower section 22 towards central hinge 14. One suitable material for bumper 56*d* is rubber. The functioning of bumper system 56 will be described later herein.

As best seen in FIGS. 7 and 11B but also shown in a number of other figures including FIGS. 5 and 8, a base plate 58 is provided proximate a lower region of lower section 22. Base plate 58 is a generally L-shaped plate having a first leg 58*a* that extends for a distance upwardly along the rear surface 22*b* of lower section 22 from proximate the bottom edge 22*d* thereof. Base plate 58 has a second leg 58*b* that extends outwardly from a lower end of first leg 58*a* and at an acute angle relative thereto. Base plate 58 extends from first side 22*e* of lower section 22 to second side 22*f* thereof and is positioned below the lowermost edges of third and fourth brackets 22*j*, 22*k*. This arrangement is shown in FIG. 5. Second leg 58*b* includes one or more cutouts 58*c* (FIG. 11B), the purpose of which will be described later herein.

Shield 23 is a generally truncated triangular shape when viewed from the front, as in FIG. 2. Since the shield 23 of right wing 12B is shown with greater clarity in FIG. 2, the various features of the shield 23 of each of the left and right wings 12A, 12B will be discussed with reference to the right wing 12B shown in that figure and the left wing 12A shown in FIG. 5. Shield 23 has a front surface 23*a*, a rear surface 23*b*, a top edge 23*c*, a bottom edge 23*d*, a first side edge 23*e*, and a second side edge 23*f*. Second side edge 23*f* of shield 23 is positioned adjacent first side edge 22*e* of lower section 22 and angles rearwardly therefrom and inwardly towards vertical axis "Y". In particular, shield 23 is oriented at an obtuse angle relative to lower section 22. The first side edges 23*e* of the two shields 23 are located adjacent one another and generally along vertical axis "Y". This can be seen in FIG. 4. At least a part of each shield 23 is generally aligned with central hinge 14 when the trip edge is in an untripped condition.

Cutting edge 24 of left wing 12A is shown in FIGS. 2 and 7 to include a front surface 24*a*, a rear surface 24*b*, a top edge 24*c*, a bottom edge 24*d*, a first side edge 24*e*, and a second side edge 24*f*. An upper region of cutting edge 24 overlaps a bottom region of lower section 22 and a plurality of fasteners 60, e.g. carriage bolts, secure cutting edge 24 to lower section 22. When cutting edge 24 is engaged with lower section 22, the bottom region of cutting edge 24 extends downwardly for a distance below the bottom end 22*d* of lower section 22. As best seen in FIG. 5, a bottom edge 24*d* of cutting edge 24 and the bottom edge 23*d* of shield 23 are substantially coplanar and comprise the regions of blade 12 that may contact the surface "G" when blade 12 is used to clear materials such as snow from the surface "G".

A clamp plate 62 (FIGS. 4 and 6) is positioned adjacent an outer surface of fourth bracket 22*k*. Fourth bracket 22*k* includes a mounting flange 64 that extends laterally outwardly from an outer surface thereof and towards second side edge 22*f*. Mounting flange 64 extends from proximate top edge of lower section 22 to a short distance above first leg 58*a* of base plate 58. Mounting flange 64 is of substantially the same thickness (from a front surface to a rear surface) as the first leg 58*a* of base plate 58. The clamp plate 62 overlaps first leg 58*a* of base plate 58 and a lower portion of mounting flange 64. A first fastener 60*a* of the plurality of fasteners 60 secures clamping plate 62, first leg 58*a*, lower section 22 and cutting edge 24 to one another. Clamp plate 62 assists in keeping mounting flange 64 engaged with lower section 22. Base plate 58, clamp plate 62, and mounting flange 64 all aid to strengthen the outer edge region of left wing 12A. The remaining fasteners 60 secure cutting edge 24, lower section 22 and first leg 58*a* of base plate 58 to one another. Base plate 58 and clamping plate 62 serve to strengthen the connection between cutting edge 24 and lower section 22. The cutouts 58*c* (FIG. 11B) help to enable a person to access some of the fasteners 60 that secure cutting edge 24 to lower section 22 so that it is easier to install or remove those fasteners 60.

A mounting plate 68 (FIG. 5) is secured to snow shield 23 by fasteners 70. Mounting plate 68 abuts first side edge 22*e* of lower section 22 and is welded to first leg 58*a* of base plate 58 and to a side edge 58*d* (FIG. 11B) of base plate 58. Mounting plate 68 strengthens shield 23 and base plate 58 helps to support and strengthen the connection between lower section 22 and cutting edge 24.

Having now described the various components of V-blade 12, an exemplary method of using the blade 12 is now described in particular reference to FIGS. 9 to 12. As indicated earlier herein, blade 12 is mounted to a front end of vehicle 10 by hitch assembly 16. Hitch assembly 16 not only secures blade 12 to vehicle 10 but is also the mechanism through which blade 12 is manipulated in order to clear snow "S" from a surface "G", "G1", and "G2".

An operator stands on platform 10*a* (FIG. 1) of vehicle 10 and operates vehicle 10 and blade 12 through manipulating controls 10*b*. Vehicle 10 is driven forwardly over the surface "G" in the direction indicated by arrow "C" in FIG. 9. Blade 12 is positioned to remove snow "S" from the surface "G". In other words, blade 12 is lowered via actuation of the hitch assembly 16 so that the bottom edge 24*d* of cutting edge 24 and the bottom edge 23*d* of snow shield 23 of each of the left and right wings 12A, 12B of blade 12 are placed on the surface "G" or just slightly above surface "G". The actual height of bottom edges 23*d*, 24*d* is set utilizing the skid shoes 38, as has been previously described herein. As the vehicle 10 continues to move in the direction "C", snow is captured by the curved blade 12 and is pushed forwardly in front of blade 12 and thereby removed from the surface "G".

FIG. 10A shows blade 12 again but the snow has been removed from the figure for clarity of illustration. Both the bottom 24*d* of cutting edge 24 and the bottom 23*d* of shield 23 are in contact with the surface "G" or in close proximity thereto as blade 12 travels with utility vehicle 10 in the direction "C". Additionally, the shoe 38*b* of skid shoe 38 slides along surface "G". If the operator wishes to lift the bottom edges 24*d*, 23*d* further off the surface "G", he or she will adjust the distance of the blade 12 from the surface by increasing the number of washers 38*e* below skid shoe mount 38*c*. Increasing the number of washers 38*e* will lift the cutting edge 24 and snow shield 23 slightly further off the surface "G" but the shoe 38*b* of the skid shoe 38 will continue to slide over the surface "G". If the operator finds the blade 12 is not adequately clearing snow "S" from surface "G", he or she can remove one or more washers from the group of washers below the skid shoe mount 38*c*. The removal of one or more washers 38*e* will lower the blade 12, moving it closer to the surface "G" and thereby bring bottom ends 24*d*, 23*d* into better contact with surface "G". Shoe 38*b* of skid shoe 38 will continue to slide across the surface "G" as before.

Figure 10A:
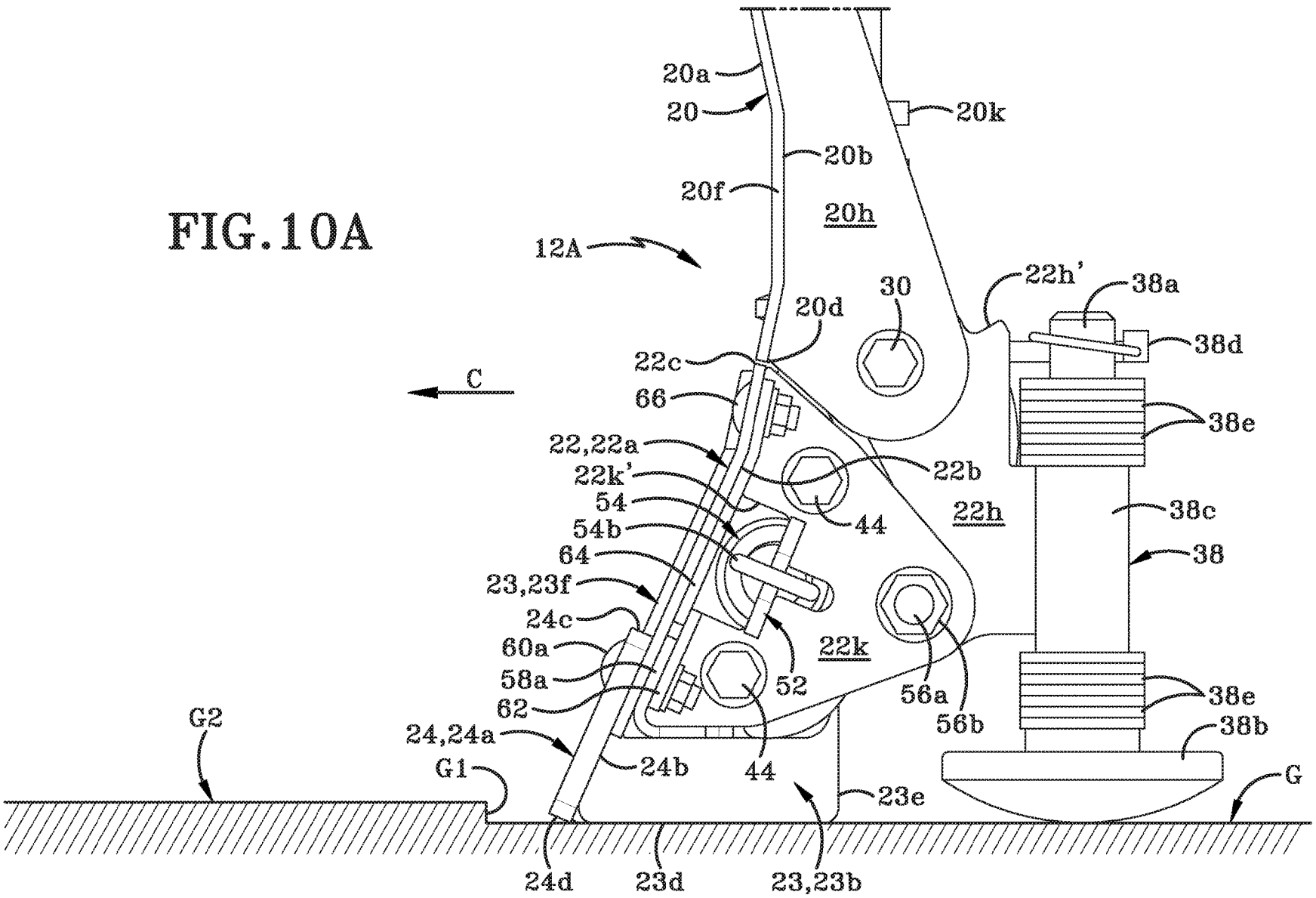
FIG. 10A is a partial left side elevation view showing the position of the blade when in contact with the surface immediately before reaching the obstacle on the surface; and wherein the snow has been removed for clarity of illustration.

FIGS. 10A and 11A show that the surface "G" has an obstacle "G1" at a location a distance in front of the vehicle 10 and the left wing 12A of blade 12 is in a working position where the blade 12 is able to be used for snow removal. In this particular instance, the obstacle "G1" is in the form of raised region of the roadway or sidewalk along which the vehicle 10 is moving. In particular, the elevation of the roadway or sidewalk changes from a first elevation "G" to a second elevation "G2" at the obstacle "G1". It will be understood that the illustrated obstacle "G1" is exemplary of any type of solid obstacle that may lay in the path of the moving blade 12. The obstacle "G1" is sufficiently raised relative to the surface "G" that if the blade 12 strikes it and does not trip, the impact could damage blade 12.

In accordance with an aspect of the present disclosure and in order to aid in preventing or limiting impact damage to blade 12, the trip edges on the blade (i.e., the components 22, 23, and 24 of one or both wings 12A, 12B) are designed to trip. The term "trip" is used herein to describe a pivoting action of the lower section 22, snow shield 23, and cutting edge 24 relative to upper section 20 and about axis "X". This tripping action occurs when the bottom edge 24*d*, 23*d* encounters the transition "G1". The pivoting tripping action is indicated in FIG. 11A by the arrow "D". When the trip edge (lower section 22, snow shield 23, and cutting edge 24) pivots, it does so about the horizontal axis "X" and thereby moves out of alignment with the upper section 20 of the moldboard.

Adjustment screws 26 (FIG. 8) help to control the extent to which the trip edge 22, 23, 24 pivots. The operator may change how far the trip edge travels when it pivots by rotating the adjustment screws in a first direction to lower the nut 26*c* (FIG. 8) or raise the nut 26*c*.

Because the cutting edge 24 is secured to lower section 22, when the bottom edge 24 of the cutting edge 24 strikes the obstruction "G1", the cutting edge 24 lower section 22, and snow shield 23 pivot in unison about the horizontal axis "X" that extends along shaft 28 of the torsion spring assembly. The pivotal motion winds up torsion springs 34 and 36, storing potential spring force therein. As best seen in FIGS. 7 and 8, each of the first and second brackets 22*g*, 22*h* on lower section 22 defines a stop 22*g*', 22*h*', respectively, in their top edges. When lower section 22 pivots about horizontal axis "X" in the direction "D", first and second brackets 22*g*, 22*h* will ultimately come into contact with horizontal third plate section 20*p* on upper section 20. In particular, the stops 22*g*', 22*h*' will contact third plate section 20*p* and the third plate section 20*p* will arrest any further pivotal motion of lower section 22 in the direction "D".

Figure 10B:
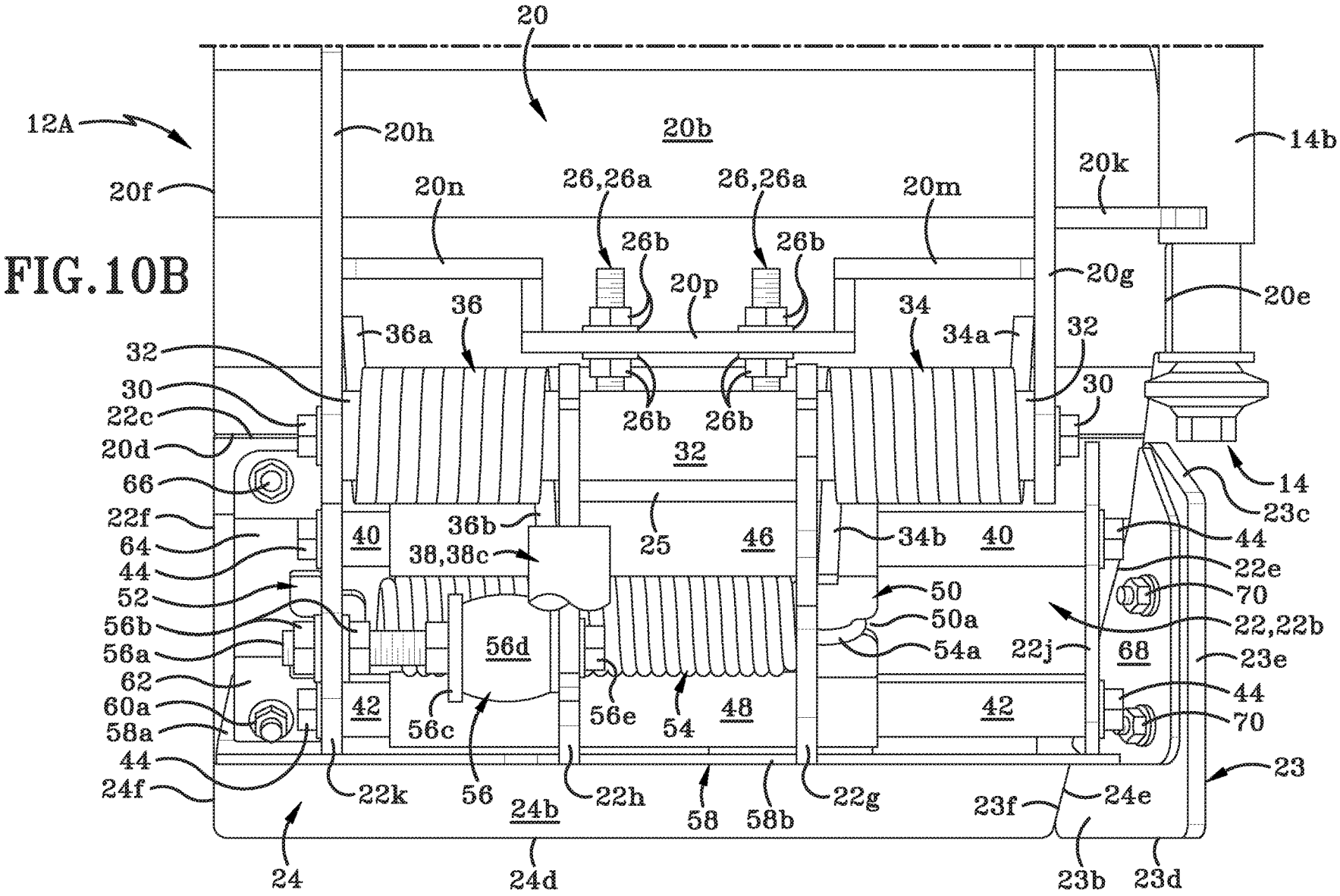
FIG. 10B is a rear elevation view of the blade shown in FIG. 10A with the skid shoe partially removed for clarity of illustration.

The tripping of the trip edge, i.e., lower section 22, snow shield 23, and cutting edge 24, also causes a lateral movement of the trip edge. The lateral movement of the left wing 12A is shown in FIG. 11B and is indicated by the arrow "E". This motion "E" is a motion in a first direction moving away from central hinge 14 and is in a direction parallel to the horizontal axis "X". It will be understood that the right wing 12B will move away from the central hinge 14 and the left wing 12A in the opposite direction to arrow "E". As left wing 12A translates in the direction of arrow "E", first and second guide rods 40, 42 are caused to move through first and second sleeves 46, 48 in the direction of arrow "E". The motion also causes third bracket 22*j* on lower section to move closer to first bracket 22*g* and causes fourth bracket 22*k* to move further away from second bracket 22*h*. As fourth bracket 22*k* moves away from second bracket 22*h*, the coil spring 54 stretches in length. The increase in length of coil spring 54 can be seen by comparing FIG. 10B with FIG. 11B. FIGS. 10B and 11B also show that the tripping motion moves shield 23 laterally further away from central hinge 14 and thereby further away from the shield 23 of the right wing 12B. The two snow shields 23 on the left and right wings 12A, 12B therefore do not interfere with one another as the trip edges of the left and right wings 12A, 12B pivot in the direction "D". The translating of the two trip edges is effectively caused by each trip edge pushing the other trip edge away from it. As the trip edge of left wing 12A trips, the skid shoe 38 will be lifted off the surface "S". However, because the skid shoe is operatively engaged with second bracket 22*h*, the skid shoe 38 does not translate horizontally with the lower section 22.

Utility vehicle 10 will continue moving forwardly in the direction of arrow "C" and as soon as the trip edge has pivoted about the horizontal axis "X" and translated horizontally parallel to the horizontal axis "X", the spring forces exerted by the torsion springs 34, 36 and 54 will cause the trip edge to automatically return to its original position. Effectively, the "trip event" is over and the trip edge returns to a position where it effectively aids the upper section 20 of the moldboard to remove snow from the surface "G2". In particular, the first and second torsion springs 34, 36 will return to their at-rest position and as they do so, the second ends 34*b*, 36*b* thereof will push on first sleeve 46 and cause lower section 22, shield 23, and cutting edge 24 to pivot in unison about the horizontal axis "X" in a direction indicated by arrow "F" in FIG. 12. This pivotal motion "F" is in the opposite direction to the pivotal motion "D" caused by the tripping of the blade 12. The pivotal motion will continue until lower section 22 returns to its at-rest position shown in FIG. 6 where it is generally aligned with upper section 20 of the moldboard.

At substantially the same time that the lower section 22, shield 23, and cutting edge 24 are pivoting in the direction "F" about longitudinal axis "X", the coil spring 54 will begin to return to its at-rest position (i.e., from the position shown in FIG. 11B to the position shown in FIG. 10B). As the coil spring 54 contracts, it will translate the lower section 22 and cutting edge 24 horizontally relative to the upper section 20 and in the opposite direction to arrow "E" (FIG. 11B). It will be understood that the lower section 22, shield 23, and cutting edge 24 of right wing 12B will translate in the direction of arrow "E". In other words, the trip edges of the left and right wings 12A, 12B will each move back towards the central hinge 14.

As the trip edge 22, 23, 24 returns to its at-rest position (FIG. 10B) from its laterally translated position (FIG. 11B), the movement of the trip edge in the opposite direction to arrow "E" is arrested by stop plate 56*c* contacting the resilient bumper 56*d* extending outwardly from second bracket 22*h*. The resiliency of bumper 56*d* dampens the return movement and ensures that trip edge will gently return to its original position prior to the trip event.

The pivoting of the lower section 22, shield 23, and cutting edge 24 in the direction "F" will also bring skid shoe 38 once again back into contact with surface "G". Continued motion of the vehicle 10 in the direction indicated by arrow "C" will allow blade 12 to continue to remove snow "S" from the surface. That surface is now the elevated surface "G2".

As indicated earlier herein, the left wing 12A and right wing 12B are capable of articulating relative to one another about central hinge 14. The operator will utilize the control panel 10*b* on vehicle 10 to manipulate the left and right wings 12A, 12B to the desired orientation relative to one another to effectively remove snow "S" from surface "G" or "G2". In other words, the wings 12A, 12B can form an inverted V-shape, a straight blade shape, or a V-shape or any shape therebetween. In any of these instances, should another trip event occur, the pivoting and translating trip edge will ensure there is little likelihood of damage occurring to the cutting edge 24 and snow shields 23 through inadvertent contact between the two wings 12A, 12B.

A method of using blade 12 in accordance with the present disclosure, as will be summarized hereafter, helps to ensure that the blade 12 will be less likely to be damaged if it impacts an obstacle "G1" while being used to clear snow off a surface "G". The method includes providing a trip edge 22, 23, 24 on a moldboard 20 of each of a left wing 12A and a right wing 12B of the V-blade 12; biasing the trip edge 22, 23, 24 into alignment with the upper section 20 of the moldboard with a torsion spring assembly 28, 32, 34, 36; impacting an obstacle "G1" on a surface "G" with the trip edge 22, 23, 24; pivoting (in a direction "D"—FIG. 11A) the trip edge 22, 23, 24 relative to the upper section 20 of the moldboard about a horizontal axis "X" when the trip edge impacts the obstacle "G1"; and translating the trip edge 22, 23, 24 laterally in a first direction "E" relative to the upper section 20 of the moldboard and parallel to the horizontal axis "X" using a translation assembly provided on the blade 12. The translating of the trip edge 22, 23, 24 in the first direction "E" includes moving the trip edge away from a central shaft 14 with which each of the left wing 12A and right wing 12B are engaged.

As the trip edge 22, 23, 24 translates horizontally in the direction "E", 1 coil spring 54 of the translation assembly expands, and guide rods 40, 42 of the translation assembly slide through associated sleeves 46, 48. Additionally, a stop plate 56*c* of the translation assembly moves laterally a distance away from a bumper 56*d* provided on the translation assembly. The snowplow 10 will continue to move forwardly in the direction "C" and beyond the obstacle "G1". Substantially immediately after the trip edge 22, 23, 24 has tripped in the direction "D" and translated horizontally in the first direction "E", the trip edge will start to translate laterally in an opposite second direction to the arrow "E" under spring force as the coil spring 54 returns to its at rest condition. The trip edge 22, 23, 24 will also substantially simultaneously start to pivot in the direction "F" (FIG. 12) under spring force from the torsion springs 34, 36 until the trip edge is once again generally in alignment with the upper section 20 of the moldboard.

The method of using blade 12 further includes providing a snow shield 23 along a first side of the trip edge, i.e., the first side 22*e* of lower section 22 of the moldboard and at least partially beneath the central shaft 14. Having the trip edges 22, 23, 24 of the left wing 12A and right wing 12A able to translate away from one another in opposite directions by moving outwardly away from the central shaft 14, helps to avoid contact between the snow shield 23 provided on the left wing 12A and the snow shield 23 provided on the right wing 12B.

It will be understood, obviously, that if the obstacle "G1" is only in the path of one of the left wing 12A and right wing 12B, then only the trip edge 22, 23, 24 of that particular wing of the blade 12 will trip. If the obstacle "G1" extends across at least a portion of the roadway or sidewalk surface in front of both of the left wing 12A and right wing 12B, both trip edges 22, 23, 24 will trip, pivoting about the horizontal axis "X" and translating laterally outwardly away from one another in order to avoid contact between the two snow shields 23 and thereby aiding in preventing damage to the trip edges and to the snow shields 23 provided thereon.

While it has been described that left wing 12A and right wing 12B are engaged with central hinge 14 and are selectively pivotable relative to vertical axis "Y", it will be understood that in other embodiments, the upper sections 20 of the left and right wings may be fixedly welded to a central shaft or post instead of to central hinge 14. In these instances, the left and right wings of the blade 12 remain in a fixed orientation relative to one another and to the central shaft at all times. In these embodiments, the trip edge will be substantially as illustrated and described with respect to V-blade 12 and will function in the same way as described herein.

While it has been shown and described herein that the trip edge comprises the lower section 22, the snow shield 23, and the cutting edge 24, in other embodiments, the snow shield 23 may be omitted from the trip edge. In some embodiments, the snow shield 23 may be omitted from the V-blade altogether. In other embodiments, the snow shield may be fixedly engaged with central hinge 14 or on a central shaft. The snow shield may then remain in a fixed orientation relative to the central hinge 14 or the central shaft at all times.

It will be understood that if cutting edge 24, base plate 58, and/or snow shield 23 become damaged or worn down over time, the operator may simply remove the fasteners 60 and/or 70, disengage the damaged cutting edge 24, base plate 58, and/or snow shield 23 from the lower section 22 and install a new/replacement component. The new/replacement component will be secured to the lower section 22 by reengaging the fasteners 60 and/or 70.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A V-blade for a snowplow comprising:

a left wing; and a right wing;

wherein each of the left wing and right wing includes:

a moldboard;

a trip edge pivotable relative to the moldboard about a horizontal axis;

a biasing assembly biasing the trip edge into alignment with the moldboard; and a translation assembly biasing the trip edge towards a central vertical axis interposed between the left wing and the right wing;

wherein the translation assembly translates the trip edge linearly in a first direction parallel to the horizontal axis when the trip edge pivots out of alignment with the moldboard.

2. The V-blade according to claim 1, wherein the moldboard comprises an upper section and a lower section that are separate from one another;

wherein the lower section comprises a first member of the trip edge and is operatively engaged with the upper section of the moldboard via the biasing assembly.

3. The V-blade according to claim 2, wherein the trip edge includes a second member and the second member is cutting edge that is operatively engaged with the lower section of the moldboard.

4. The V-blade according to claim 3, wherein the trip edge includes a third member and the third member is a snow shield that pivots and linearly translates in unison with the first member and second member.

5. The V-blade according to claim 1, wherein each of the left wing and the right wing further comprises a snow shield that forms a part of the trip edge and is at least partially aligned with the central vertical axis.

6. The V-blade according to claim 5, wherein the snow shield angles rearwardly from a rest of the trip edge and further angles inwardly toward the central vertical axis.

7. The V-blade according to claim 1, where the trip edge is translated horizontally in the first direction moving away from a central vertical axis of the blade.

8. The V-blade according to claim 1, wherein the translation assembly includes a spring which biases the trip edge toward a central vertical axis of the blade.

9. The V-blade according to claim 1, wherein the translation assembly includes a bumper that dampens horizontal movement of the trip edge in an opposite second direction.

10. The V-blade according to claim 1, further comprising a stop that limits pivotal motion of the trip edge relative to the moldboard.

11. The V-blade according to claim 1, further comprising a skid shoe operatively engaged with the trip edge, and wherein the skid shoe pivots and translates horizontally with the trip edge.

12. The V-blade according to claim 1, wherein the central vertical axis extends along central shaft that is part of a central hinge operationally engaging the left wing and right wing to one another, and wherein the left wing and the right wing are pivotable about the central vertical axis that extends along the central shaft.

13. The V-blade according to claim 1, wherein the left wing and right wing are selectively individually pivotable about the central vertical axis.

14. The V-blade according to claim 4, wherein the translation assembly includes:

a guide rod;

a sleeve circumscribing the guide rod; and a coil spring that moves from an at-rest condition when the trip edge moves in the first direction and the guide rod moves through the sleeve.

15. A snowplow comprising:

a utility vehicle;

a V-blade; and a hitch assembly securing the V-blade to the utility vehicle, said hitch assembly being actuatable to manipulate the V-blade;

wherein the V-blade comprises:

a left wing;

a right wing;

wherein each of the left wing and right wing includes:

a moldboard;

a trip edge pivotable relative to the moldboard about a horizontal axis;

a biasing assembly biasing the trip edge into alignment with the moldboard; and a translation assembly that translates the trip edge linearly in a first direction parallel to the horizontal axis when the trip edge pivots out of alignment with the moldboard.

16. A method of preventing damage to a V-blade of a snowplow comprising:

providing a trip edge on a moldboard of each of a left wing and a right wing of the V-blade;

biasing the trip edge into alignment with the moldboard;

pivoting the trip edge relative to the moldboard about a horizontal axis when the trip edge impacts an obstacle on a surface along which the blade is traveling; and translating the trip edge laterally in a first direction relative to the moldboard and parallel to the horizontal axis when the trip edge pivots after impacting the obstacle on the surface.

17. The method according to claim 16, wherein the translating of the trip edge in the first direction includes moving the trip edge away from a central shaft with which each of the left wing and right wing are engaged.

18. The method according to claim 16, further comprising:

pivoting the trip edge about the horizontal axis and back into alignment with the moldboard; and substantially simultaneously translating the trip edge laterally in an opposite second direction relative to the moldboard.

19. The method according to claim 18, wherein the translating of the trip edge in the opposite second direction is accomplished under spring force.

20. The method according to claim 17, further comprising:

providing a snow shield along a first side of the trip edge and at least partially beneath the central shaft;

avoiding contact between the snow shield provided on the left wing and the snow shield provided on the right wing by translating the trip edge on the left wing away from the trip edge on the right wing.

* * * * *